US007997169B1

(12) United States Patent
Hack

(10) Patent No.: US 7,997,169 B1
(45) Date of Patent: Aug. 16, 2011

(54) HOUSED EXTENSION BAR

(76) Inventor: Timothy L. Hack, Morgantown, KY (US)

( * ) Notice: Subject to any disclaimer, the term of this patent is extended or adjusted under 35 U.S.C. 154(b) by 432 days.

(21) Appl. No.: 11/925,447

(22) Filed: Oct. 26, 2007

Related U.S. Application Data

(63) Continuation-in-part of application No. 11/403,356, filed on Apr. 13, 2006, now abandoned.

(51) Int. Cl.
*B25B 23/16* (2006.01)

(52) U.S. Cl. ..... 81/177.2; 81/60; 81/177.85

(58) Field of Classification Search ..... 81/60, 177.2, 81/177.85
See application file for complete search history.

(56) References Cited

U.S. PATENT DOCUMENTS

| | | | | |
|---|---|---|---|---|
| 1,310,473 | A * | 7/1919 | Fullenwider | 81/57.45 |
| 2,342,610 | A * | 2/1944 | Elliott | 451/358 |
| 4,586,406 | A | 5/1986 | Howard | |
| 4,611,514 | A * | 9/1986 | Hyde | 81/60 |
| 4,817,476 | A | 4/1989 | Karge | |
| 4,905,548 | A | 3/1990 | Colace et al. | |
| 4,907,660 | A * | 3/1990 | Staggs et al. | 175/320 |
| 4,957,387 | A | 9/1990 | Nasu | |
| 4,960,015 | A | 10/1990 | Mathews | |
| 4,962,682 | A | 10/1990 | Rose et al. | |
| 5,112,156 | A | 5/1992 | Boyer | |
| 5,289,745 | A | 3/1994 | Beardsley | |
| 5,366,313 | A * | 11/1994 | LaBarre | 403/108 |
| 5,471,899 | A | 12/1995 | Twomlow | |
| 5,732,605 | A | 3/1998 | Mann | |
| 6,170,365 | B1 | 1/2001 | Zerver | |
| 6,186,879 | B1 * | 2/2001 | Ericsson | 451/358 |
| 6,286,395 | B1 | 9/2001 | Frazier | |
| 6,321,855 | B1 * | 11/2001 | Barnes | 173/211 |
| 6,327,941 | B1 | 12/2001 | Cheng | |
| 6,647,830 | B2 | 11/2003 | Marquardt | |
| 6,736,034 | B1 * | 5/2004 | Gonzales | 81/177.85 |
| 6,832,762 | B2 | 11/2004 | Hu | |
| 6,832,531 | B1 | 12/2004 | Marquardt | |
| 6,840,142 | B2 | 1/2005 | Cheng | |
| 6,883,402 | B2 | 4/2005 | Cerda | |
| 6,923,094 | B1 | 8/2005 | Marquardt | |
| 2004/0007102 | A1 | 1/2004 | Wilhelm | |
| 2004/0093997 | A1 | 5/2004 | Huang | |
| 2004/0103761 | A1 | 6/2004 | Pillow | |
| 2004/0118254 | A1 | 6/2004 | Chen | |
| 2004/0211300 | A1 | 10/2004 | Wang | |

* cited by examiner

*Primary Examiner* — Joseph J Hail, III
*Assistant Examiner* — Shantese McDonald
(74) *Attorney, Agent, or Firm* — King & Schickli, PLLC

(57) ABSTRACT

The housed socket extension has a high strength tubular housing with a socket extension apparatus which fits within the housing and protrudes from the ends of the housing. Two bearing retaining devices are mounted on the socket extension apparatus, adjacent to the ends of said housing. The first end of the socket extension receives a ratchet wrench or power tool, and the second end of the socket extension apparatus is designed to mate with the square hole of a socket or tool bit.

1 Claim, 28 Drawing Sheets

HOUSED EXTENSION BAR

This application is a continuation-in-part application of and claims priority to U.S. patent application Ser. No. 11/403,356 filed on Apr. 13, 2006.

FIELD OF THE INVENTION

The housed socket extension relates to a new and novel apparatus to allow for the safe holding by human hands of a socket extension apparatus while being rotary actuated, particularly with a high speed motorized power source, such as a pneumatic impact wrench or any other rotary device that could be used with a socket extension apparatus.

BACKGROUND OF INVENTION

The housed socket extension was designed to mitigate problems which arise in use with the conventional socket extension. Presently, a mechanic, technician or factory worker, while using a socket extension connected to a motorized power tool, must grasp the rotating socket extension with a bare hand to support the weight of the tools and direct the socket extension and socket to its point of use. This practice is dangerous, due to the extreme speeds that the socket extension may be rotating, which can be in excess of 15,000 RPMs (revolutions per minute). In addition, many times the socket extensions have metal debris, chips, slivers and other matter on their surface that could harm the hand during rotation of the socket extension, The high rate of speed can cause burns, abrasions, lacerations and other forms of damage to the hands, including repetitive strain injuries, such as Carpal Tunnel Syndrome.

An embodiment of the invention encloses a socket extension within a housing and permits rotation of the socket extension within the housing, without rotation of the housing itself. The housing can be safely supported by the user's hand during high-speed axial rotation of the socket extension and thus eliminates the potential for the user to obtain dangerous burns, abrasions, lacerations and other forms of damage to the hands by isolating the contact of the user's hands from the high-speed rotating socket extension. In addition, the housed socket extension extends the drive shaft of the power tool used in conjunction with the tool. The housed socket extension absorbs vibrations for additional reduction in operator injury and fatigue. The housed socket extension helps reduce fatigue, stress, strains and motions that could lead to dangerous injuries.

SUMMARY OF THE INVENTION

An embodiment of the invention is a housed socket extension, which has a high strength tubular housing with a first and second end and an opening extending throughout the length of the housing from the first end to the second end. A socket extension apparatus having a first and second end, which are connected by a shaft, resides inside the opening of the tubular housing and extends throughout the opening with the first and second end of the socket extension apparatus extending beyond the ends of the housing. The tubular housing is rotatably mounted onto the socket extension apparatus. Located on each of the first and second ends of the tubular housing, a friction reducing device is mounted, such as a hushing, bearing or other similar device. These friction reducing device may be retained by a retaining device mounted on the shaft of the socket extension apparatus. Additional embodiments may only utilize one friction reducing device and retaining device.

Another embodiment of the invention uses the same structure but does not utilize bearings within the ends of the tubular housing. In this embodiment, the tubular housing is constructed of a bushing material which allows the socket extension apparatus to rotate within the housing without the use of bearings.

The first end of the socket extension apparatus is designed so as to receive a ratchet wrench or power tool in a square hole located on its first end. The second end of the socket extension apparatus is square shaped so as to fit into the square hole of the socket or tool bit.

This embodiment of the invention allows a user to replace a conventional socket extension apparatus with one that is safe to hold and support with the bare hand. The housed socket extension is designed so that the outer surface of the tubular housing may be held safely with the user's bare hand while the socket extension apparatus is being rotated by any one of the several types of power driven tools, such as, but not limited to, a pneumatic impact wrench, electric impact wrench, pneumatic ratchet, electric or pneumatic drill, speed wrench and/or any other rotary device that could be used with a socket extension apparatus. This is achieved by the separation of the high-speed rotating socket extension apparatus via the rotating friction reducing devices and a non-rotating tubular housing or a non-rotating tubular housing comprised of a bushing material. It is further achieved by the optional additions of gripping textures, padding and/or the addition of an extended grip to the tubular housing.

Another use for this invention is with the use of a torque wrench device to calibrate the tightness of a nut or bolt. Typically, a hand is tightly holding the socket extension while applying a rotary force to the end of the torque wrench. The amount of force applied by the hand to the socket extension causes friction, therefore increasing the rotary drag to the wrench, which increases the torque measurement reading of the torque wrench. When using the housed socket extension in this application, the friction on the socket extension apparatus is reduced substantially, because of the friction reducing devices and/or bearing material and thus allows for a more accurate torque wrench reading.

DETAILED DESCRIPTION OF THE INVENTION

Figure 1:
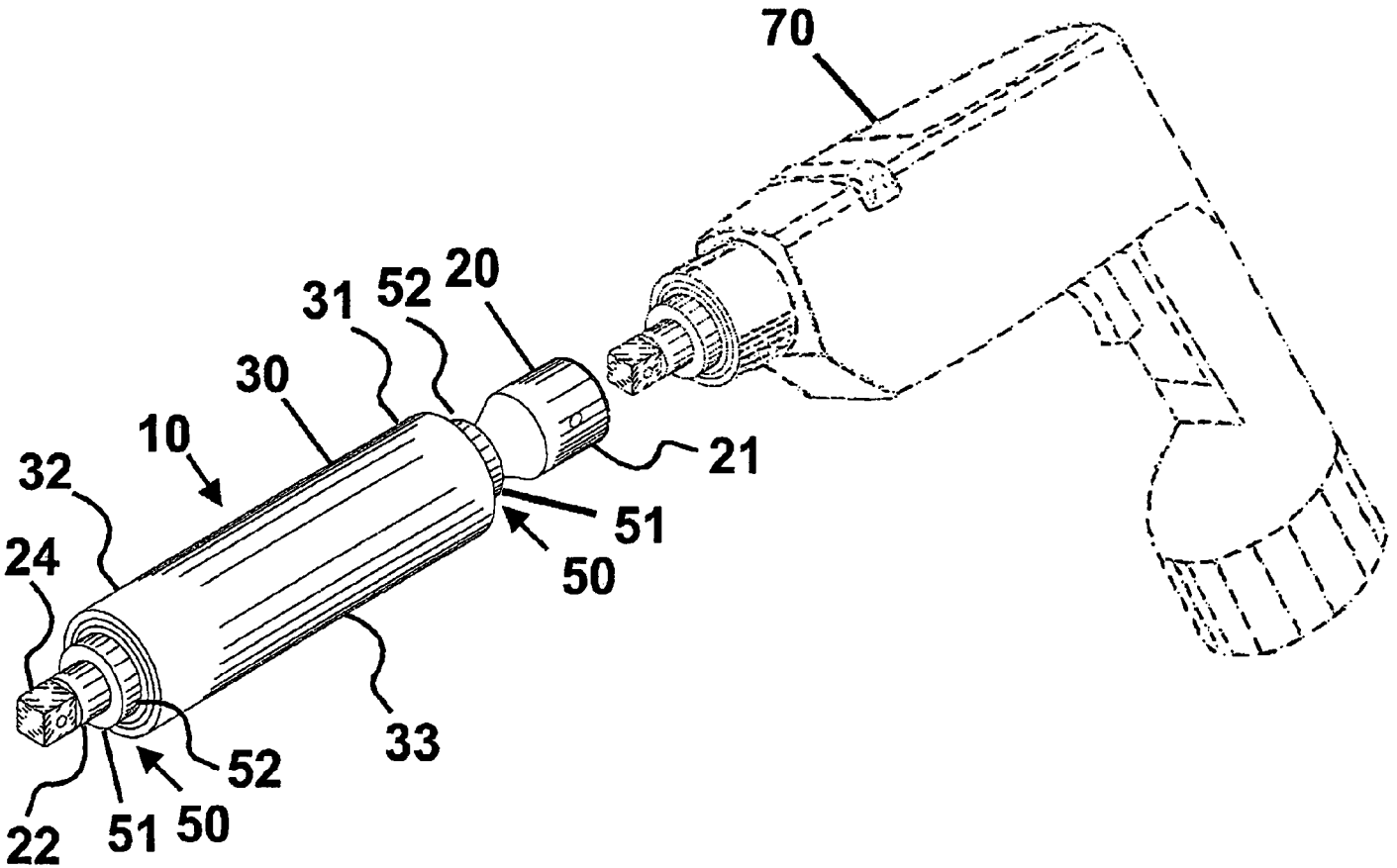
FIG. 1 shows an isometric view of the present invention.
Figure 2:
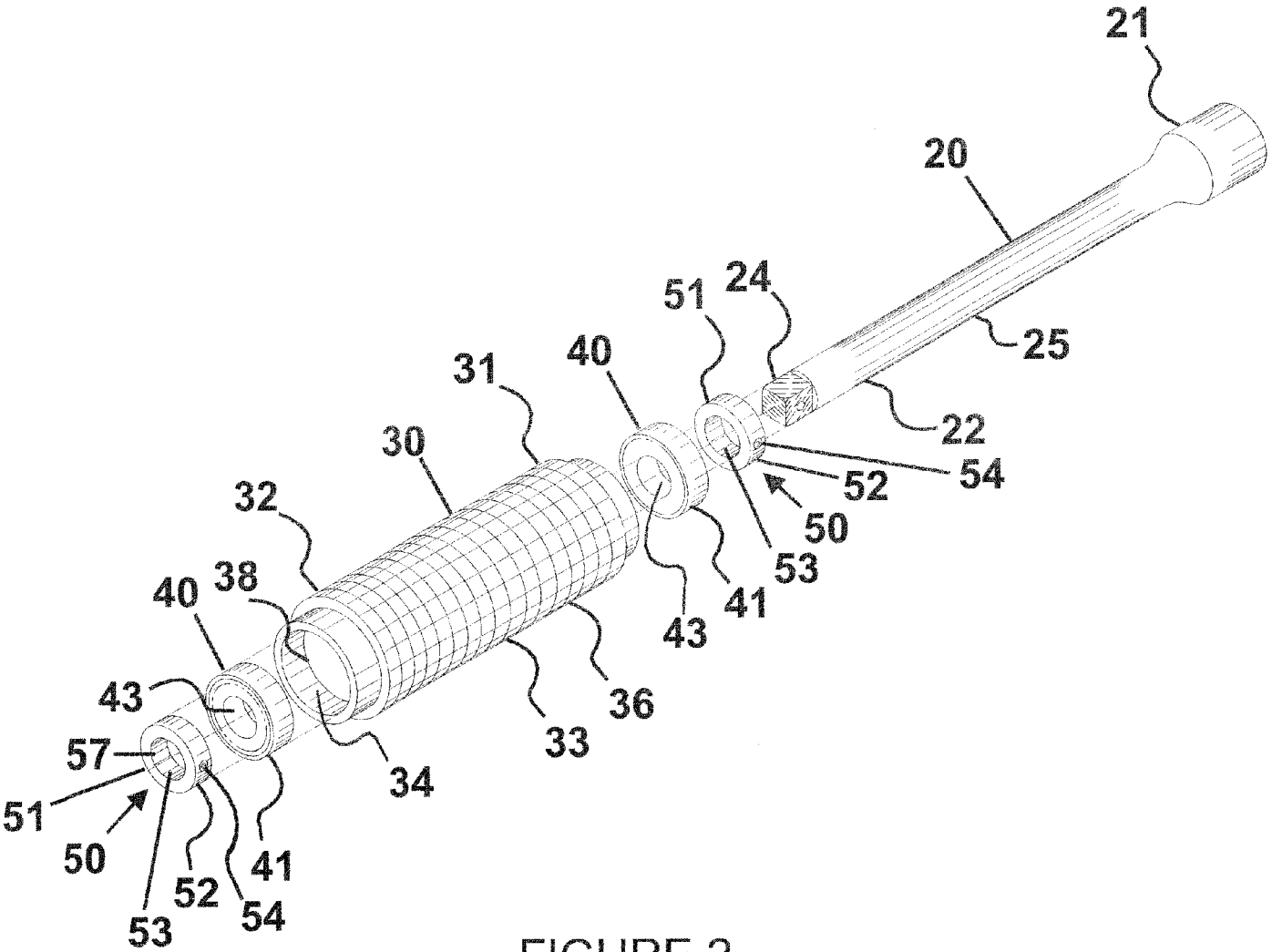
FIG. 2 shows an exploded isometric view of the present invention.

FIGS. 1 and 2 show a housed socket extension 10 which has a high strength tubular housing 30 with a first and second end 31, 32 and an opening 38 in the first end 31 that extends through the full length of the said housing 30 in the direction of the axis to the second end 32. The housing 30 has an outer surface 33 and an inner surface 34. The tubular housing 30 can be made of metal and/or high strength plastic so as to be suitable for heavy duty, high-speed rotation along with high torque while retaining a socket extension apparatus 20.

Figure 3:
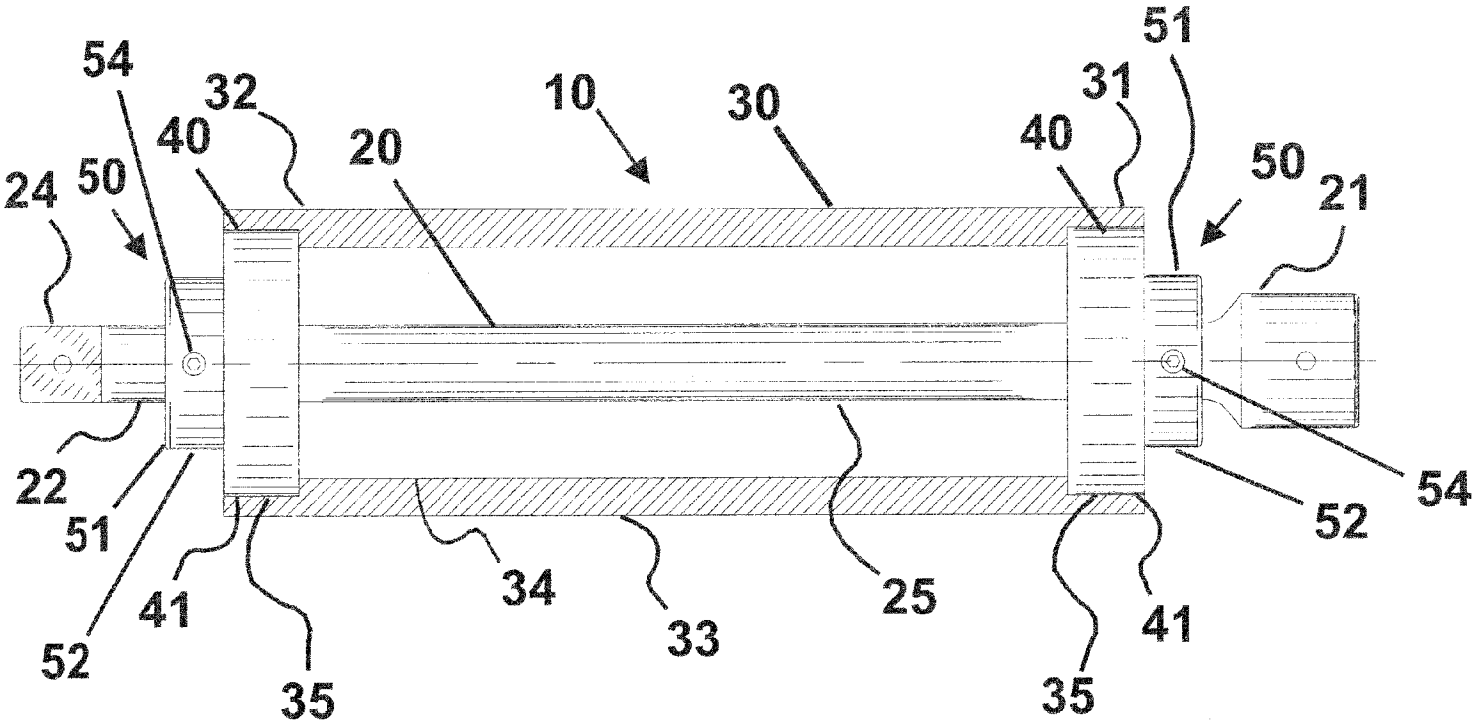
FIG. 3 shows a cut-away side view of the present invention.

As can be seen in FIG. 3, the first and second ends 31, 32 of the housing 30 may have a counter bore 35 on the inner surface 34, which extends into the housing 30 at a width and depth sufficient to accept friction reducing means such as bushings or bearings 40 or other similar device. These bushings or bearings 40 are inserted into the counter bores 35 of the housing 30. In FIG. 3, the counter bores 35 are sized to properly retain the outer surface 41 of the bearings 40 which retains the bearings 40 in place. The bearings 40 prevent the housing 30 from rotating during full load and high-speed rotation of the socket extension apparatus 20.

The overall length of the housing 30 will vary according to the application's requirement but, typically, it will be long enough so that a human hand or hands may grasp it securely and yet avoid contact of the hand to the rotating socket extension apparatus 20. By utilizing the present invention, the rotating drive of the power tool 70 is extended, making it available for a larger variety of purposes. Shorter housings 30 may be used in applications where only finger or partial hand contact support is necessary.

Figure 9:
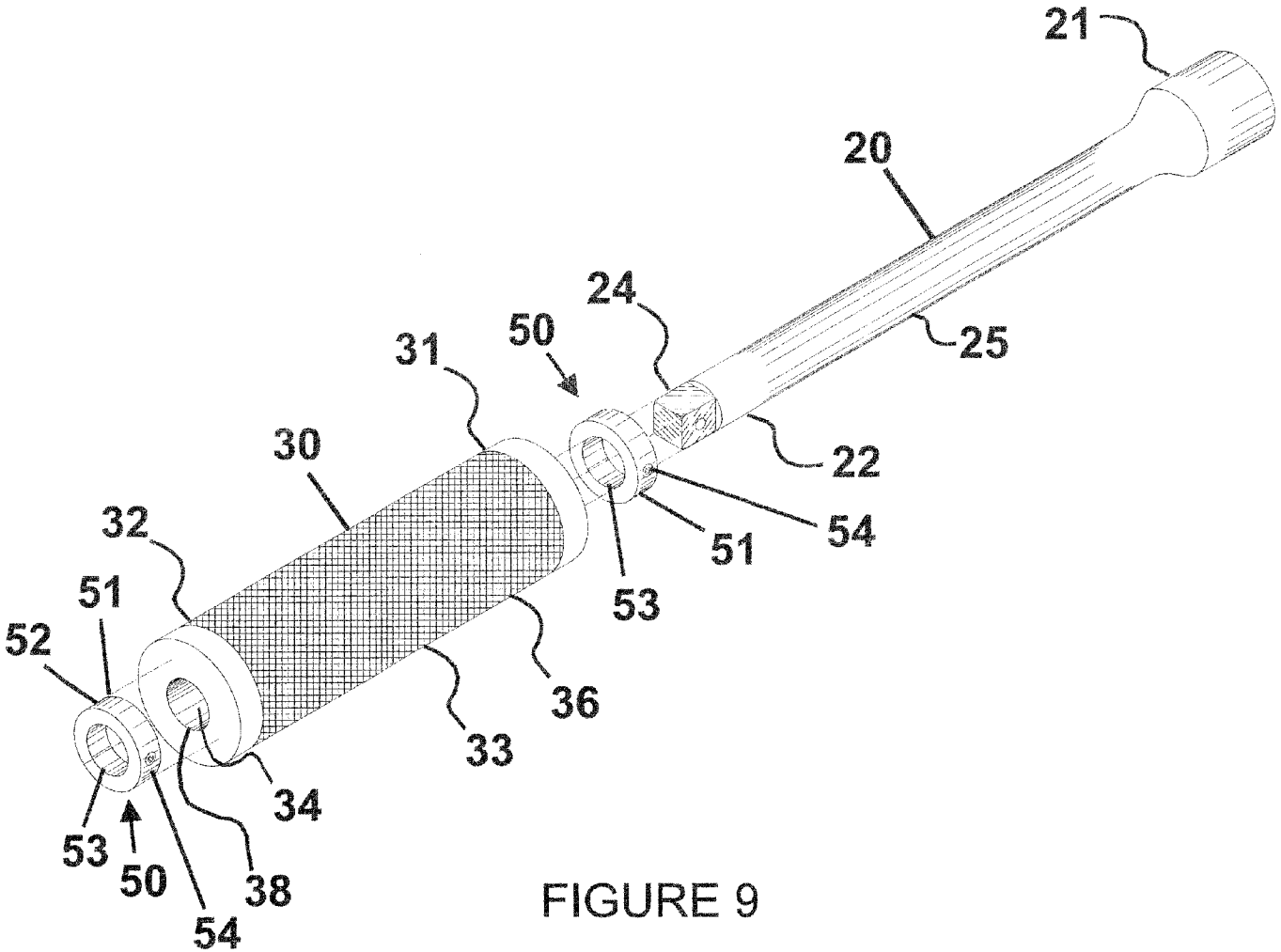
FIG. 9 shows an exploded isometric view of an alternative embodiment of the present invention.

The outer surface 33 of the tubular housing 30 may have different gripping material 36, as is shown in FIGS. 2 and 9. This gripping material 36 can be, but is not limited to, knurling, waffling, etching, ribs, grids, etc. The outer surface 33 of the tubular housing 30 may be padded with a gripping material 36, such as rubber, plastic, cloth or any other material that would improve the grip for safety, comfort or personal preference of the operator. The thickness of the gripping material 36 may vary dependent on the operator and the applications where the housed socket extension 10 is used. The gripping material 36 may be permanent, replaceable or removable.

Figure 8:
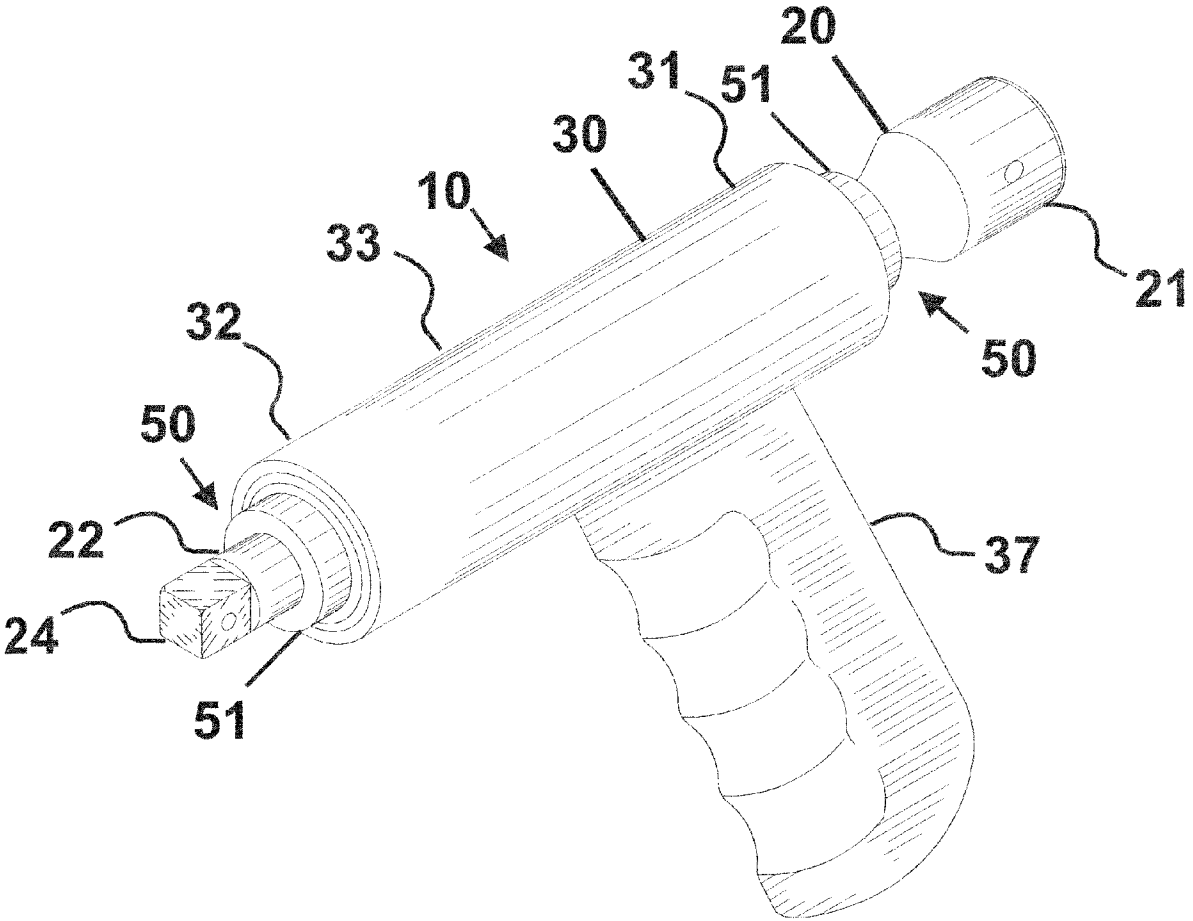
FIG. 8 shows the present invention with an extended grip.

The tubular housing 30 may be combined with an extended grip 37, as is shown in FIG. 8, such as a vertical or diagonal extension which would protrude away from the horizontal axis of the tubular housing 30 in the similar way that a conventional pistol grip would. The angle and length of this extended grip 37 may vary to suit the operator and/or applications. The extended grip 37 may be made of metal and/or high strength plastic so as to be suitable to withstand any heavy duty, high-speed rotation and high torque while retaining the socket extension apparatus 20. The extended grip 37 surfaces may be, but are not limited to, knurling, waffling, etching, ribs and/or padded with rubber, plastic, cloth or any other material that would improve the grip for safety, comfort or personal preference of the operator. The extended grip 37 and/or the gripping material 36 may be permanent, replaceable or removable.

A socket extension apparatus 20 with shaft 25 connecting a first and second end 21, 22 resides within the opening 38 of the housing 30. The housing 30 surrounds the shaft 25 of the present invention. The first and second ends 21, 22 of the socket extension apparatus 20 extend beyond each of the first and second ends 31, 32 of the housing 30.

The present invention may utilize a friction reducing device, such as bearings, bushings or other similar devices. If bearings 40 are utilized in the present invention 10, the bearings may be metal ball, roller, needle and/or solid bearing material of metal or synthetic type, providing they meet or exceed the maximum rotary and linear load requirements at the maximum speed of the socket extension apparatus 20 and the power source to be used. The bearings 40 may be sealed or shielded to prevent contamination and improve the life of the present invention 10. The bearing 40 material may be an integral part of the housing 30 or socket extension apparatus 20, providing that the material meets or exceeds the maximum axial rotary and linear load requirements at the maximum speed of the socket extension apparatus 20 and the power source to be used.

In an embodiment of the invention, the bearing retaining devices 50 are placed on the shaft 25 of the socket extension apparatus 20 and adjacent to each of the first and second ends 31, 32 of the housing 30. Several common types of bearing retaining devices 50 may be utilized in the present invention 10. One such bearing retaining device 50, as shown in FIGS. 2 and 3, consists of a round collar ring 51. The collar ring has an inner surface 53 and outer surface 52 with an opening 57 extending through its longitudinal axis. The collar ring 51 has a setscrew 54 that protrudes through the outer surface 52 of the collar ring 51 and extends through the inner surface 53. The setscrew 54, or multiple screws, make pressure contact to the socket extension apparatus 20 near each of its ends 21, 22. The setscrew 54 pressure affixes the bearing retaining device 50 to the socket extension apparatus 20 and assists in preventing the bearings 40 from moving in an axial direction away from the housing 30 but still allows the socket extension apparatus 20 to rotate freely.

Figures 4, 5, 6:
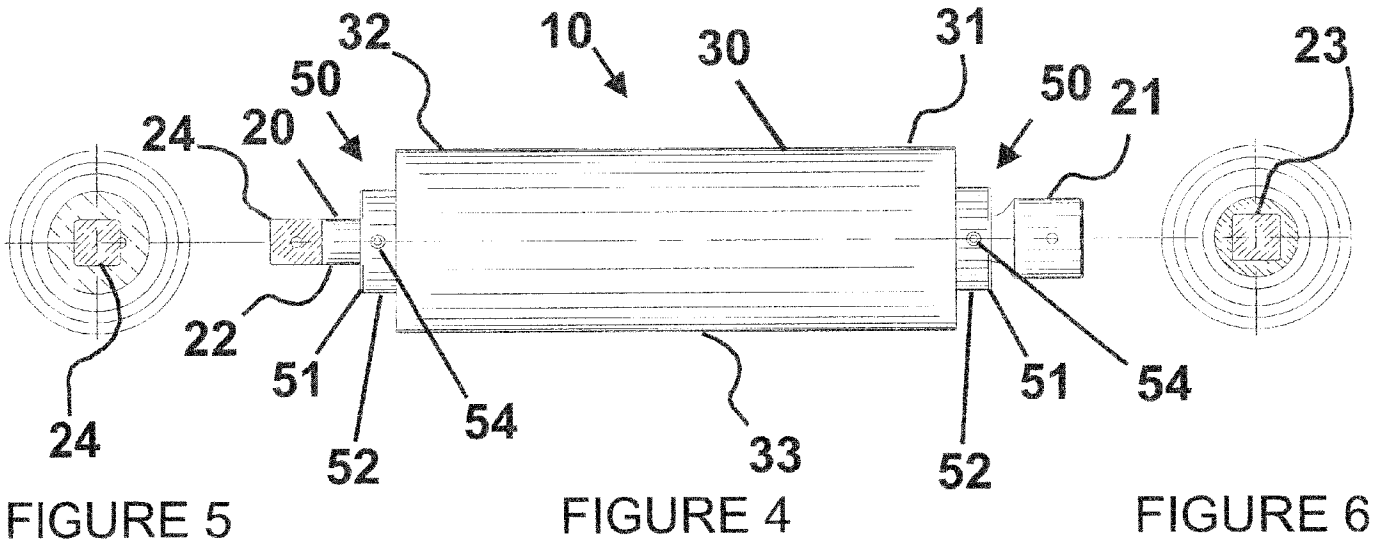
FIG. 4 shows a side view of the present invention.
FIG. 5 shows a front view of the present invention.
FIG. 6 shows an end view of the present invention.

The socket extension apparatus 20 has a second end 22 which is square-shaped with a male end 24 that can be coupled with a socket or a tool bit, as shown in FIG. 5. The first end 21 of the socket extension apparatus 20 is formed with an enlarged head, which defines a square recess 23 therein for receiving a square head of a socket wrench or power tool 70, as shown in FIG. 6. The male end 24 includes a ball provided thereon so the socket can be tightly mounted on the male end 24 of the socket extension apparatus 20.

Figure 7:
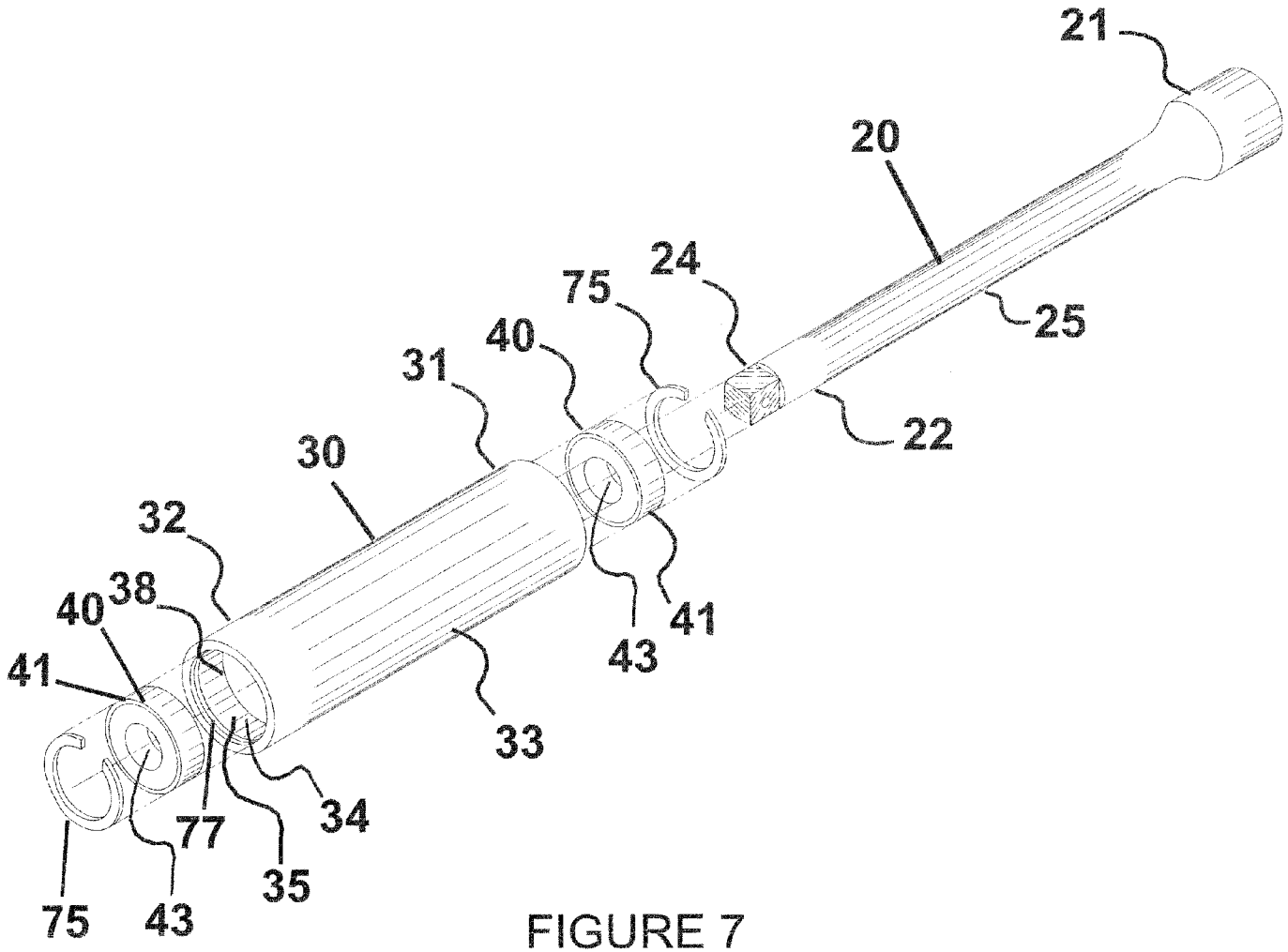
FIG. 7 shows an exploded isometric of the present invention.

Another bearing retaining device 50 is a snap ring 75, as shown in FIG. 7, and is used to restrain the friction reducing devices, such as bushings or bearings 40 from moving outward from the housing 30. The snap ring 75 is a thin round device made of a spring-type metal. The outer circumference of the snap ring 75 can be squeezed to a smaller pre-determined diameter and has the ability to expand back to its original size when the pressure is released. If snap rings 75 are utilized in the present invention 10, each of the first and second ends 31, 32 of the tubular housing 30 has a shallow groove 77 of a size and depth that will receive the snap ring 75 and retain it when it is in its expanded condition. In this embodiment, the bearings 40 will be pressed onto both ends of the socket extension apparatus 20 using an interference fit, which means the opening 43 of the bearing 40 is slightly smaller than the shaft 25 of the socket extension apparatus 20. The bearing 40 on the first end 21 of the socket extension apparatus 20 is installed before the socket extension apparatus 20 is inserted into the housing 30. The socket extension apparatus 20 with the first bearing 40 installed is then inserted into the tubular housing 30, whereas the second bearing 40 is then installed on the second end 22 of the socket extension apparatus 20. After the bearings 40 and socket extension apparatus 20 are installed into the tubular housing 30, one or more snap rings 75 are installed on each of the first and second ends 31, 32 of the housing 30. FIG. 7A shows a similar embodiment as is shown in FIG. 7, except that the friction reducing means are bushings instead of bearings.

Figure 10:
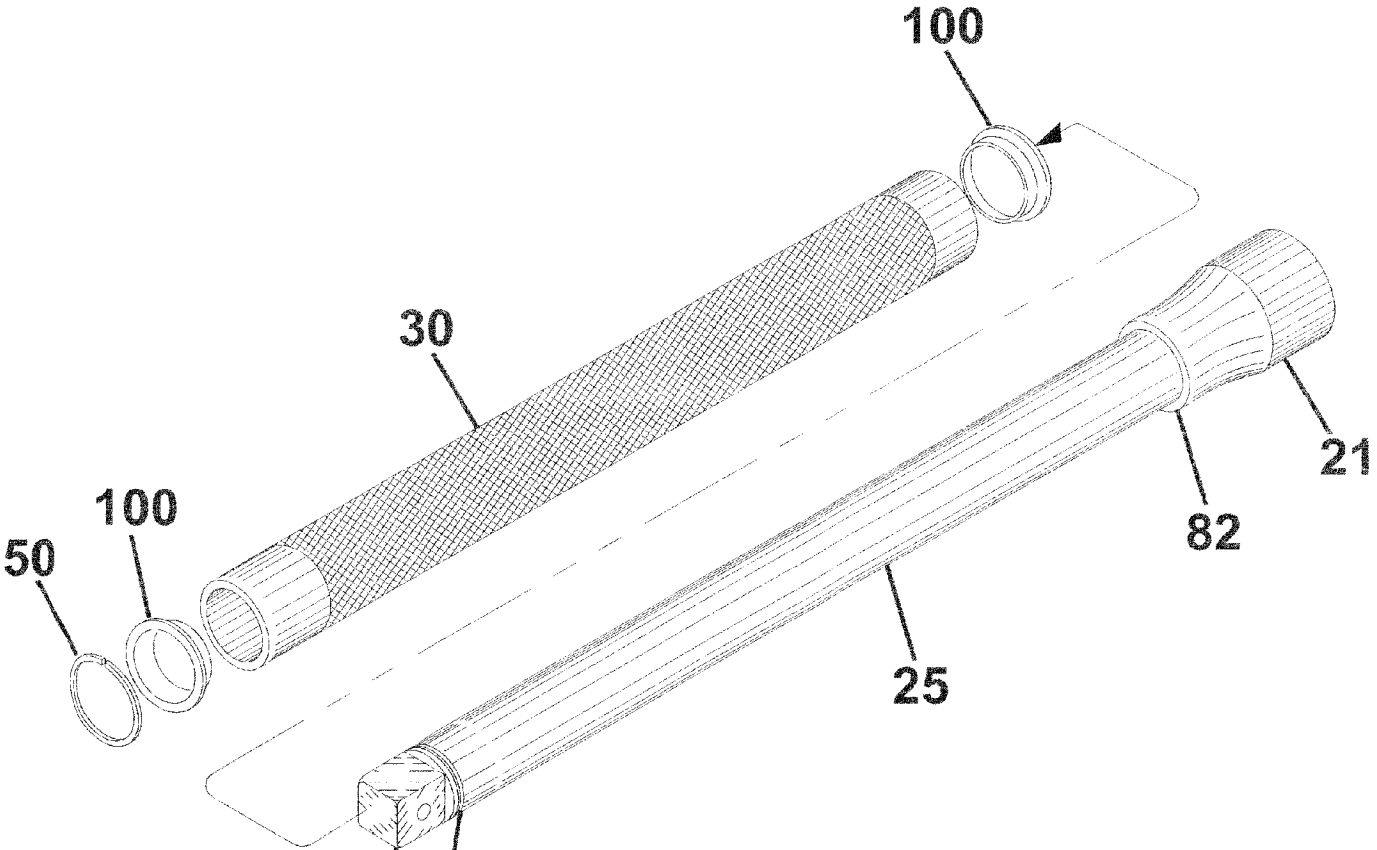
FIG. 10 shows an exploded isometric view of an alternative embodiment of the present invention.

FIG. 10 illustrates an embodiment wherein only one bearing retaining device 50 is utilized. In this embodiment, the shaft 25 of the socket extension apparatus 20 is cut into a smaller diameter forming a step 82 toward the first end 21 of the socket extension apparatus 20. The tubular housing 30 surrounds the shaft 25 and is rotatably mounted onto the shaft 25 of the extension apparatus 20. The step 82 toward the first end 21 of the socket extension apparatus 20, assists in retaining the housing 30 and any friction reducing device onto the extension apparatus 20. Friction reducing devices 100, such as bushings, bearings or other similar devices, may be used on each end 31, 32 of the tubular housing 30. A retaining device 50 such as a snap ring 75 may be used on the second end 32 of the tubular housing 30 to assist in maintaining the housing 30 onto the shaft 25 of the extension apparatus 20. This embodiment of the invention allows for a smooth finish and appearance of the present invention by making the housing 30 flush with the socket extension apparatus 20.

Figure 10A:
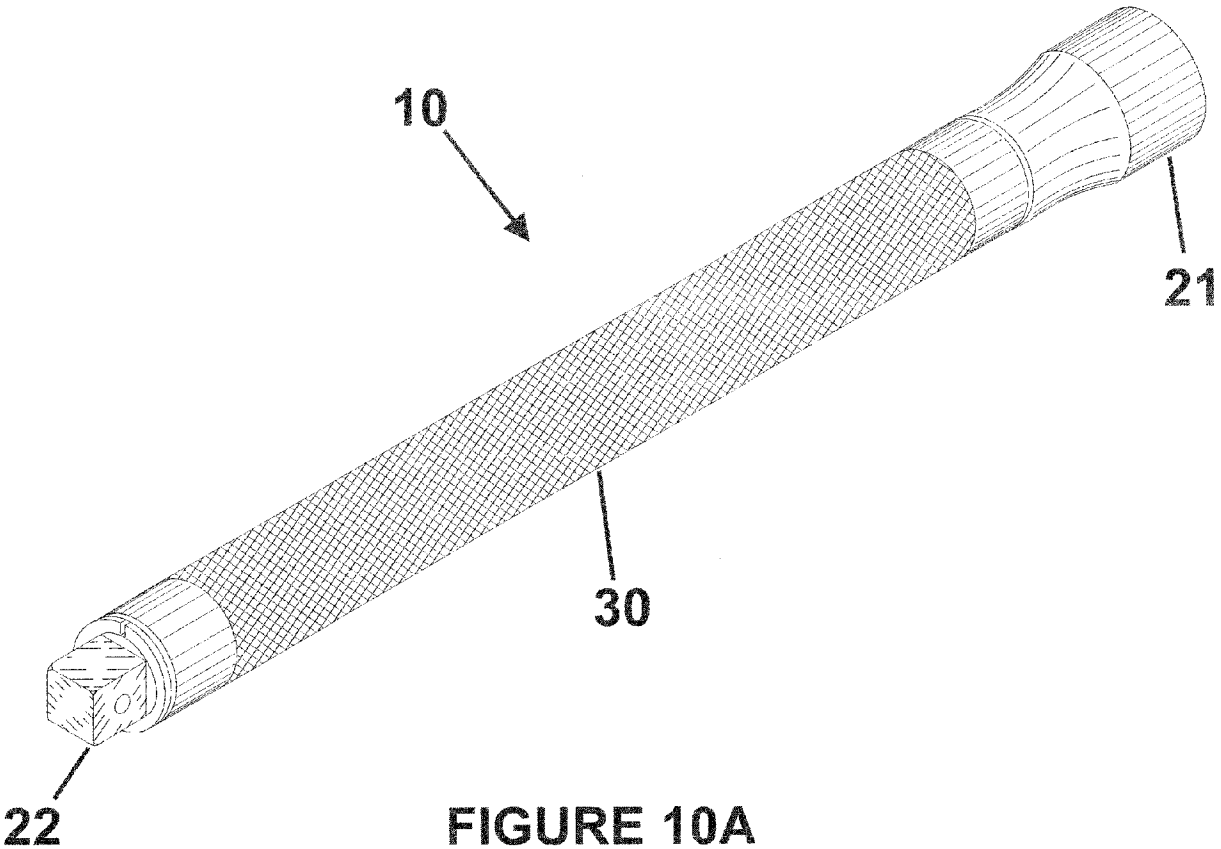
FIG. 10A shows a perspective view of an alternative embodiment of the present invention.

FIG. 10A discloses an alternative embodiment of the present invention wherein the recess 82 is formed on the shaft 25 of the socket extension apparatus 20 as is shown in FIG. 10, but the friction reducing devices 100 are not used on the first and second ends 31, 32 of the tubular housing 30. In FIG. 10A, the inner surface 34 of the tubular housing 30 is manufactured of a bushing material suitable for reducing friction between said housing 30 and the shaft 25 of the socket extension apparatus 20 and therefore allows free rotation of said socket extension apparatus 20 yet maintaining isolation between the high-speed rotating socket extension apparatus 20 and the human hand. A bearing retaining device, 50 such as a snap ring 75 may be utilized on the second end 32 of the tubular housing 30 to retain the housing 30 onto the socket extension apparatus 20. The snap ring 75 is retained by a groove 78 located toward the second end 24 of the socket extension apparatus 20.

Another embodiment of the invention is shown in FIG. 9 and consists of a tubular housing 30, a socket extension apparatus 20 and two bearing retaining devices 50. In this embodiment, the inner surface of the tubular housing 30 is manufactured of a bearing or bushing material suitable for reducing friction between said housing 30 and the socket extension apparatus 20, therefore allowing free rotation of said socket extension apparatus 20 yet maintaining isolation between the high-speed rotating socket extension apparatus 20 and the human hand.

The opening 38 in the housing 30 is slightly larger in diameter than the shaft 25 of the socket extension apparatus 20. The socket extension apparatus 20 resides inside the opening 38 of the tubular housing 30, with the first and second ends 21, 22 of the socket extension apparatus 20 extending beyond the ends 31, 32 of the tubular housing 30.

The inner surface 34 of the tubular housing 30 may be comprised of a bushing material such as, but not limited to, brass, bronze, polyamide, fluoropolymer, nylon, carbon fiber, polyimide or polyester and/or any other materials that would withstand the rotary loads and high speeds applied during use. Conversely, the shaft 25 of the socket extension apparatus 20 could be coated or layered with any of the said materials that would be compatible to the said materials of the tubular housing 30. Typically, the socket extension apparatus 20 is coated with a smooth hard chrome and therefore could be used with the tubular housing 30 made of a softer material compatible with said chrome.

A bearing retaining device 50 placed at each end of the housing 30 prevents the housing 30 from moving outward on the socket extension apparatus 20. Several common types of bearing retaining devices 50 may be utilized in the present invention 10. One such bearing retaining device 50 is shown in FIG. 9 and consists of a round collar ring 51 that has an opening 57 extending through the axis. The collar ring 51 has a setscrew 54 that protrudes through the outer surface 52 of the collar ring 51 and extends into the inner surface 53 of the collar ring 51. The setscrew 54 or multiple screws make pressure contact to the shaft 25 of the socket extension apparatus 20. The setscrew 54 pressure affixes the collar ring 51 to the socket extension apparatus 20 and restrains the tubular housing 30 from moving in an axial direction but still allows the socket extension apparatus 20 to rotate freely.

Figure 11:
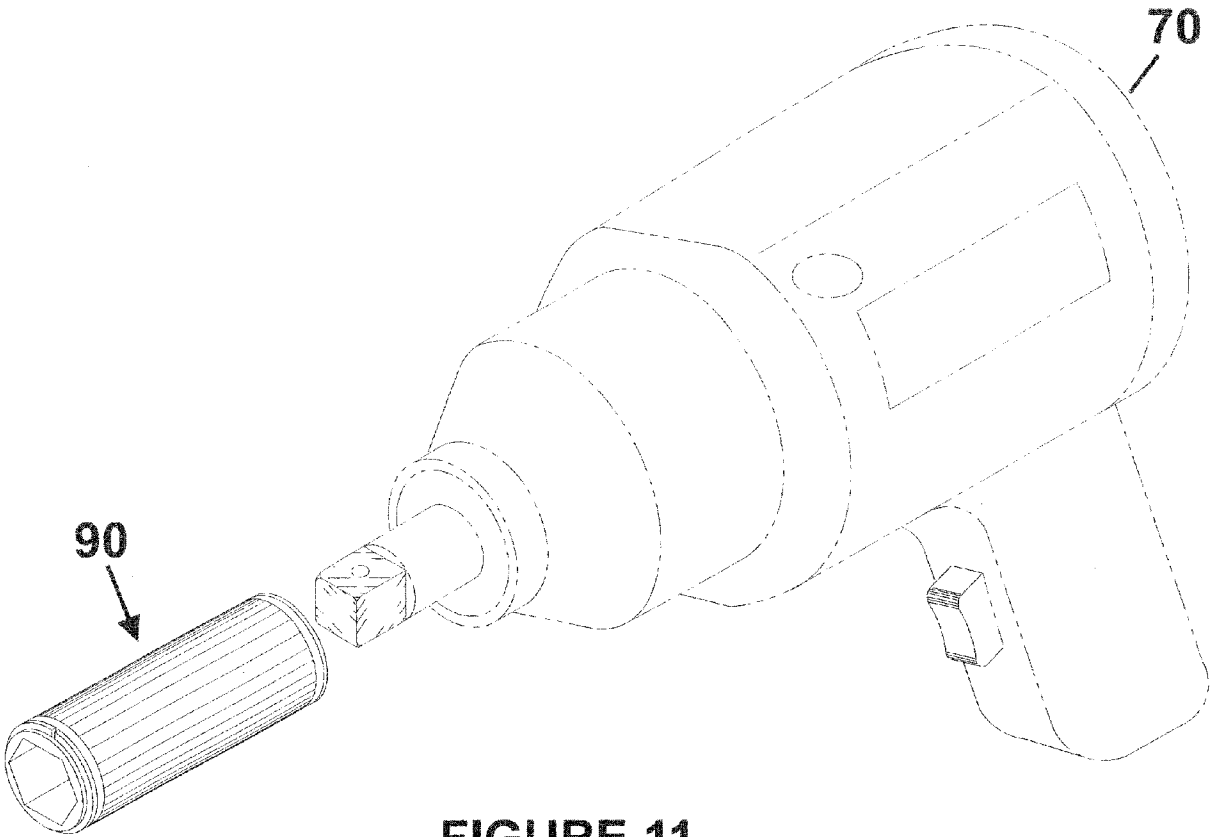
FIG. 11 shows view of an alternative embodiment of the present invention connected to a rotary power tool.
Figure 12:
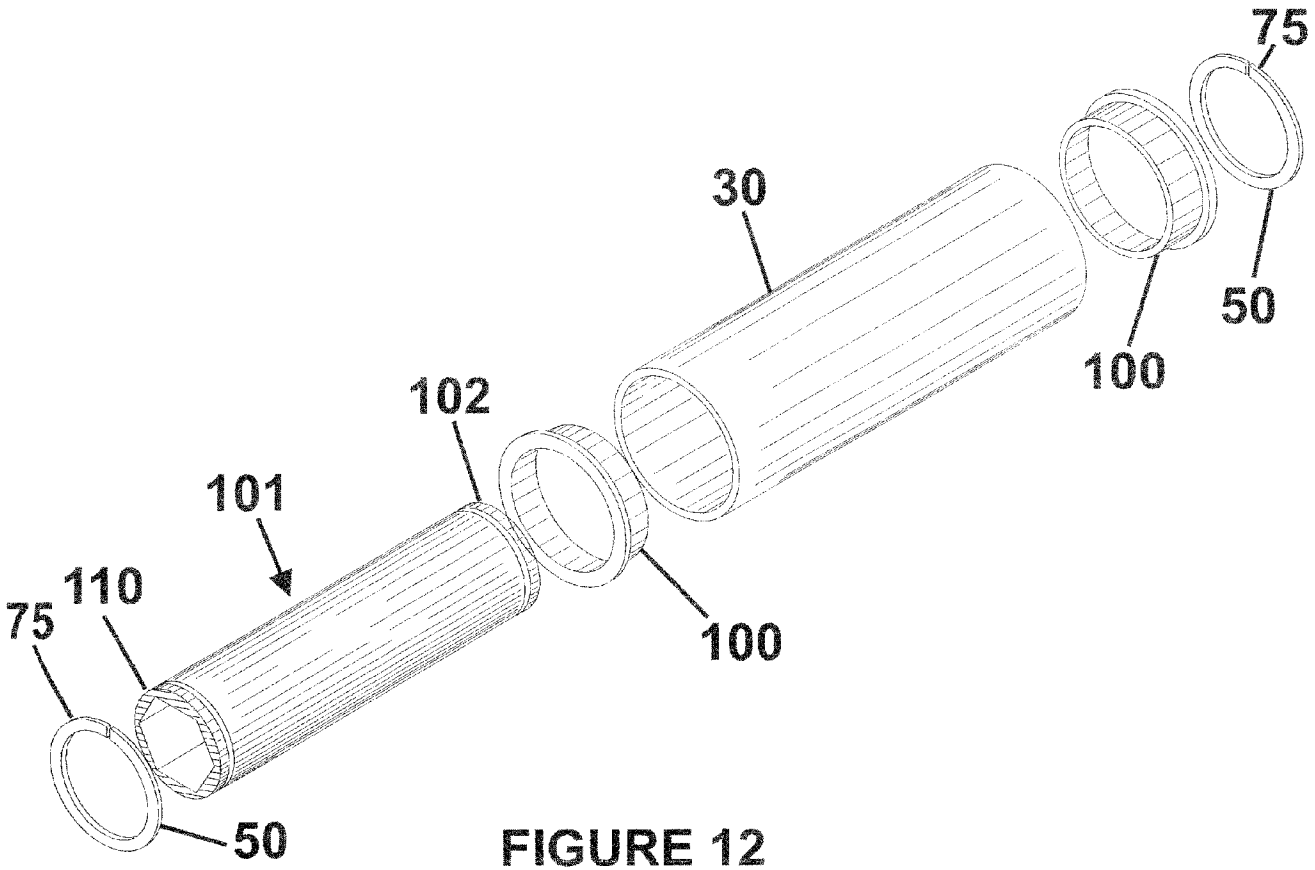
FIG. 12 shows an exploded isometric view of an alternative embodiment of the present invention.
Figure 13:
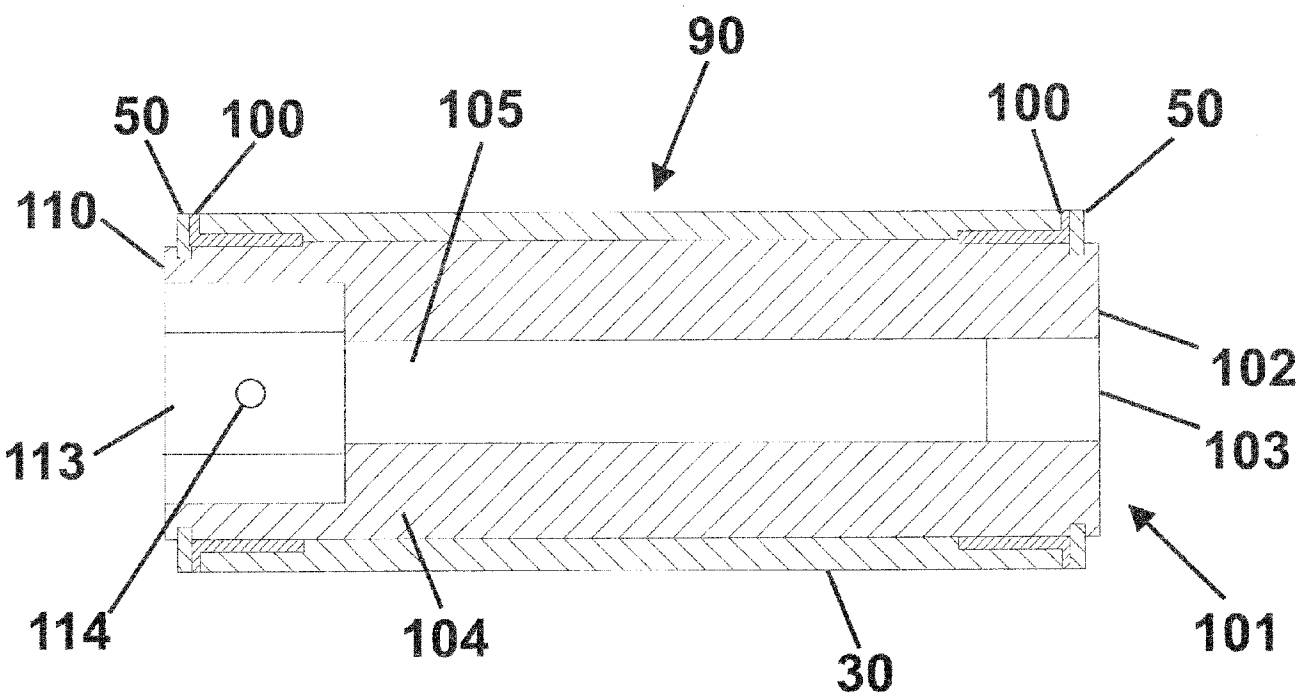
FIG. 13 shows side cut-away view of the alternative embodiment of the present invention shown in FIG. 12.
Figure 13B:
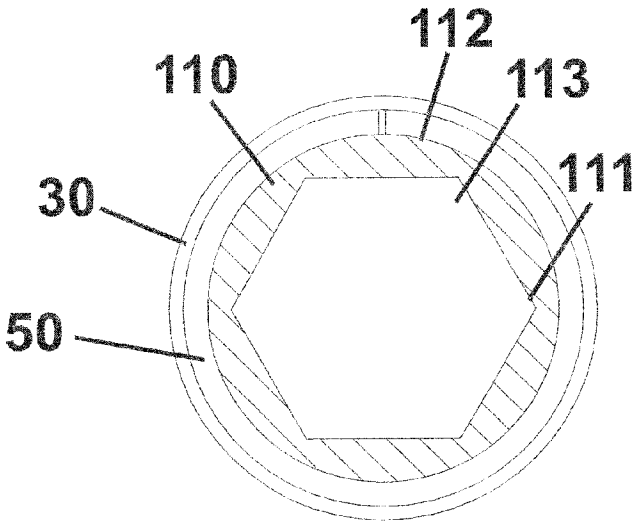
FIG. 13B shows end view of second end of the alternative embodiment of the present invention shown in FIG. 12.
Figure 13A:
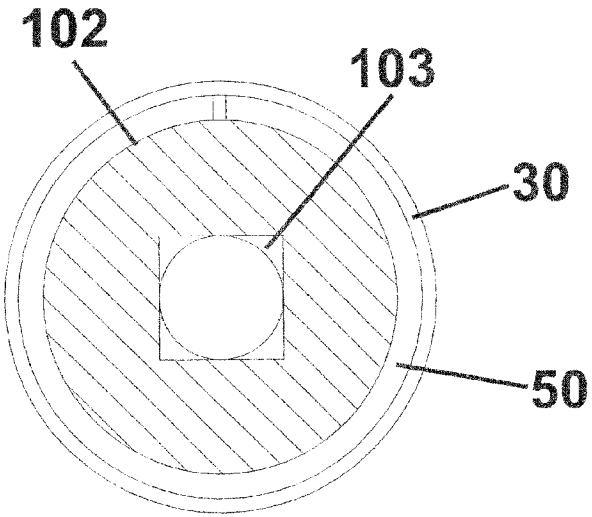
FIG. 13A shows end view of first end of the alternative embodiment of the present invention shown in FIG. 12.
Figure 17:
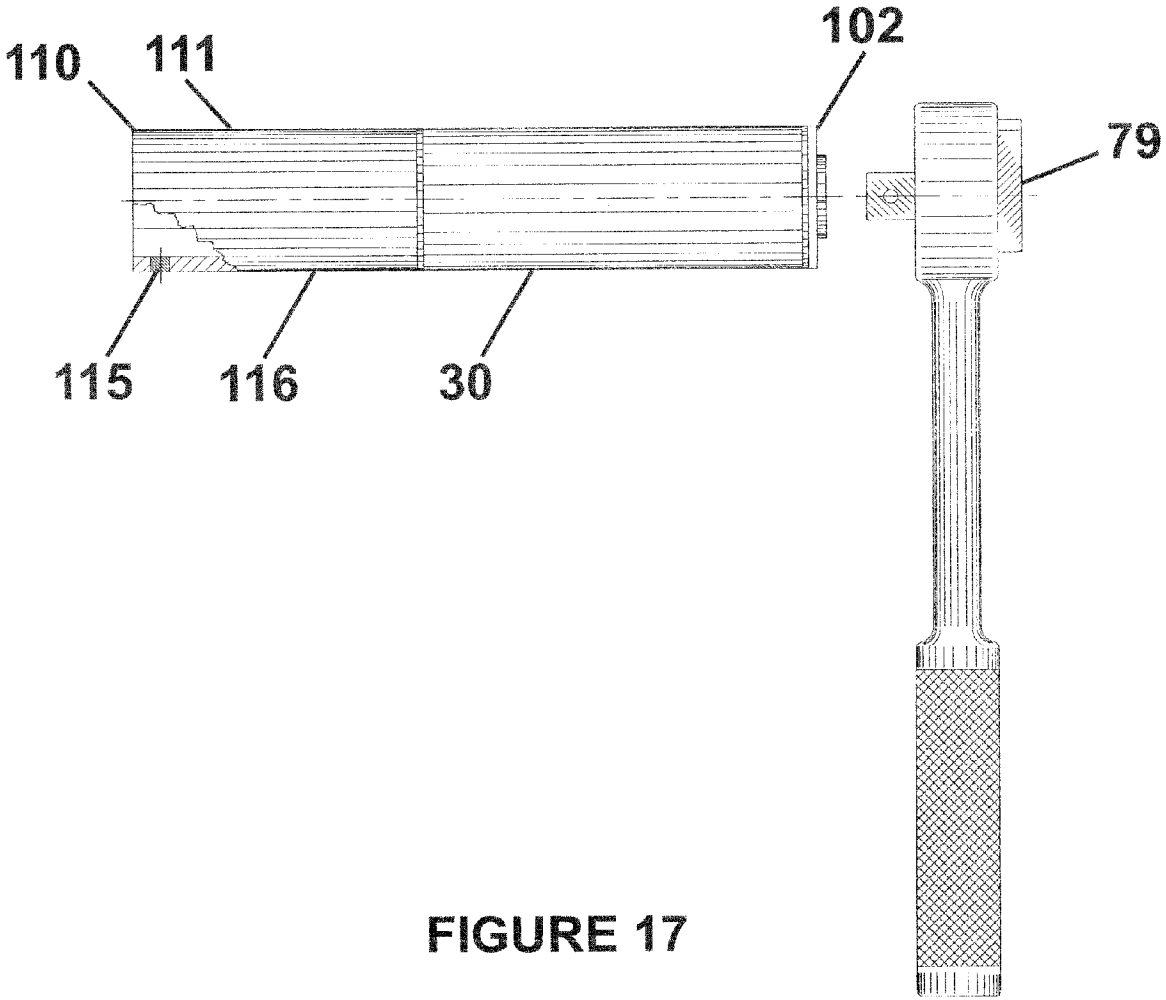
FIG. 17 shows a side view of the alternative embodiment of the present invention shown in FIG. 16 in use with a ratchet.

FIGS. 11 and 12 disclose an alternative embodiment of the present invention, a housed extension bar 90. In FIG. 11, an alternative embodiment is shown connected to a motorized power source 70, which effectively extends the rotary drive of the power tool. The present invention may also be used in conjunction with a hand ratchet as is shown in FIG. 17. FIG. 12 shows an exploded view of the alternative embodiment. The extension bar 101 shown in FIGS. 11 and 12 is a single unit which has a first 102 and second end 101 which are connected by a shaft 104. A housing 30 has an opening extending throughout the length of the housing and the housing 30 surrounds the shaft 104 of the extension bar 101. The housing 30 is rotatably mounted onto the extension bar 101 and allows the extension bar 101 to rotate within the housing 30. The housing 30 may have an inner surface 34 made of a bushing material. One or more retaining devices 50 may be utilized to retain the housing 30 onto the extension bar 101. Bushings are used as a friction reducing device 100 for the embodiment shown in FIG. 12. The second end 110 of the extension bar 101 is a female receiving unit 111 which has a cylindrical outside diameter shape 112, with a hexagon shaped recession 113. The first end 102 of the extension bar 101 defines a square recess 103 therein for receiving a square head of a socket wrench or power tool 70. The recessions 103, 113 present on the first and second ends 102, 110 of the extension bar each open into a chamber 105 that extends throughout the shaft 104 of the extension bar 101 as can be seen in FIG. 13. FIGS. 13A and 13B show views of the first 102 and second 110 ends of the alternative embodiment of the present invention shown in FIGS. 11, 12 and 13.

The second end 110 of the extension bar 101 is capable of receiving a variety of additional tools or adaptors. The second end 110 of the extension bar 101 can accept a tool with a coupling mechanism as the one shown in FIGS. 30A and 30B as a detent 114 is present on the sidewall of the hexagonal shaped recession 113, which would allow it to couple with such a coupling mechanism.

The embodiment of the present invention disclosed in FIGS. 11 and 12 discloses a chamber 105 which connects the recessions on the first and second ends 102, 110 of the extension bar 101. If the additional tools or adaptors which fit into the second end 110 of the extension bar are elongated, then the presence of the chamber 105 within the shaft 104 allows the present invention to accommodate the tool or adaptor.

Figure 14:
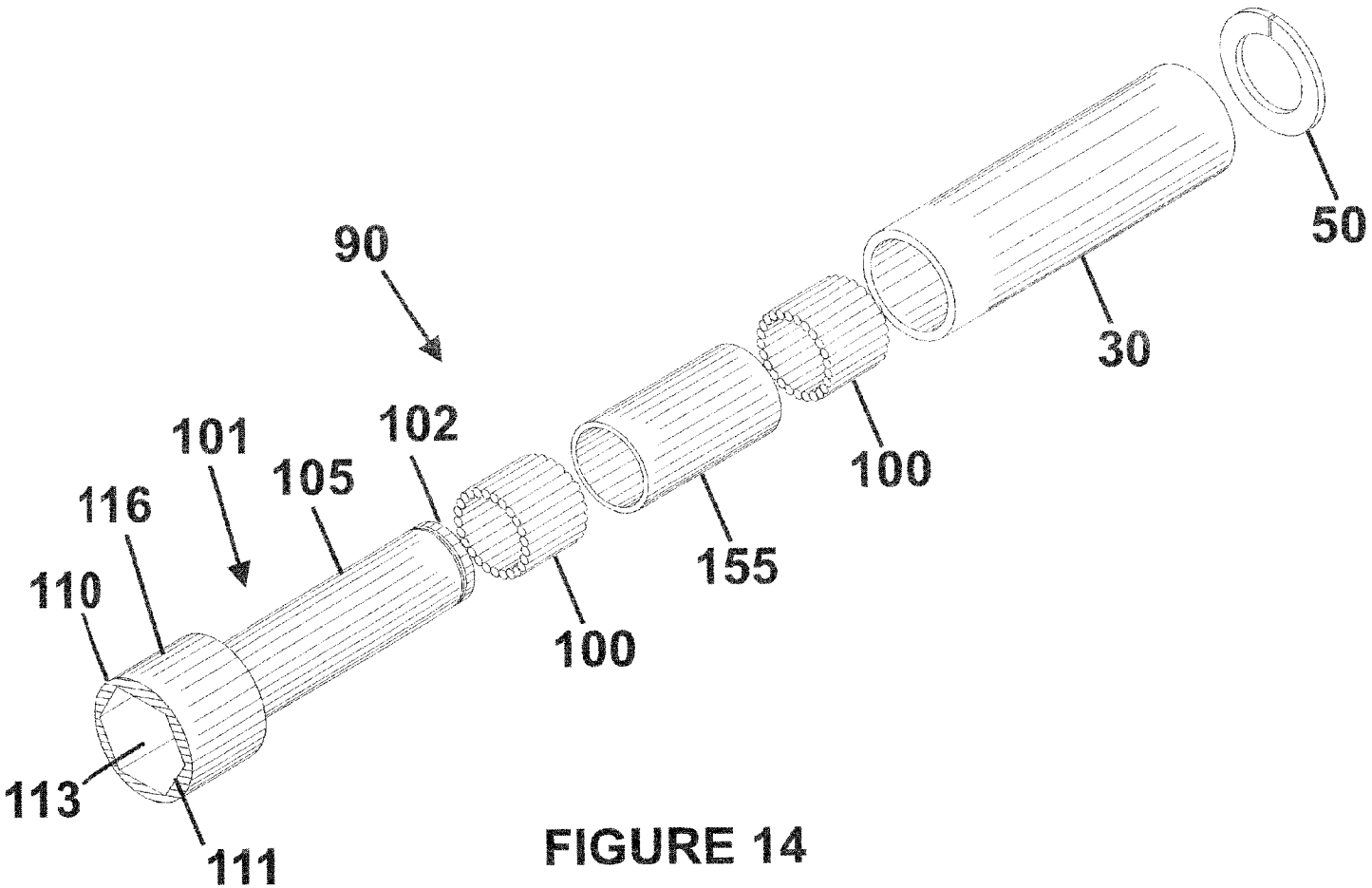
FIG. 14 shows an exploded view of an alternative embodiment of the present invention.
Figure 15:
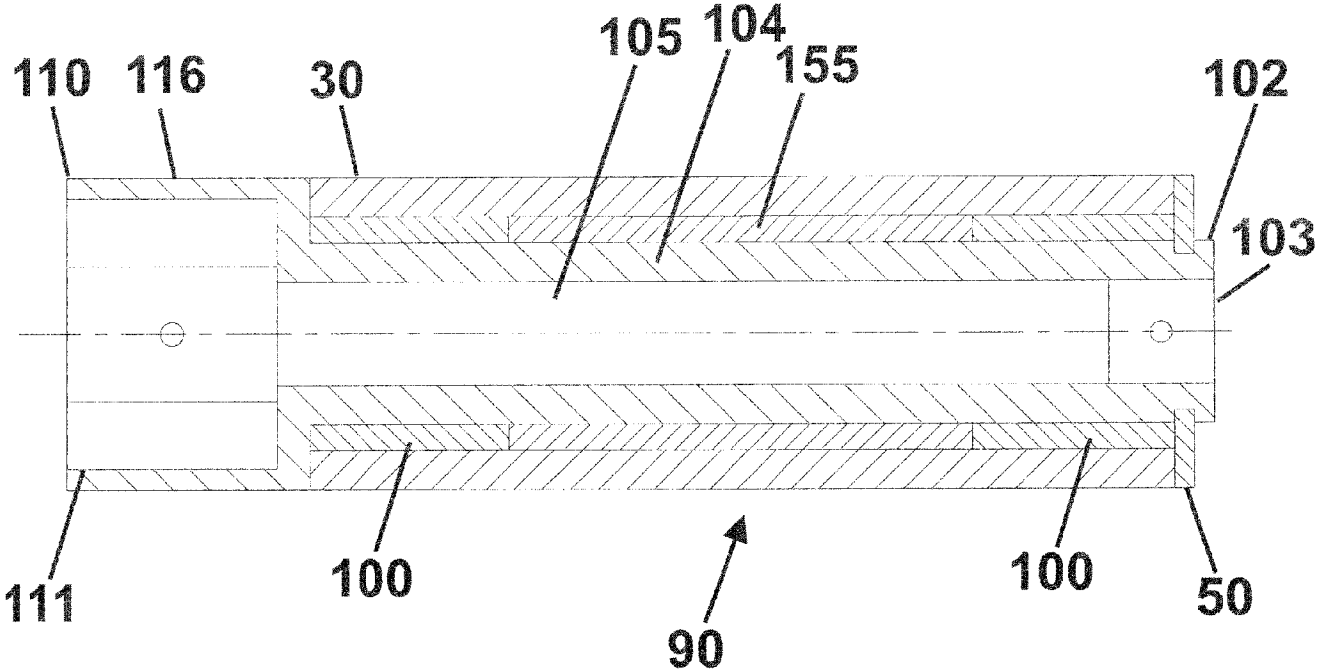
FIG. 15 shows cut-away side view of an alternative embodiment of the present invention.

Another alternative embodiment of the present invention is shown in FIG. 14. In this embodiment, the extension bar 101 also has a first and second end 102, 110 connected by a shaft 104. A tubular housing 30 surround the shaft 104 of the extension bar 101 and is rotatably mounted onto the shaft 104. In this embodiment of the present invention, the second end 110 of the extension bar 104 has an enlarged head 116 which forms a female receiving end 111. The enlarged head 116 may have a cylindrical outside diameter shape 112 with a hexagon shaped recession 113 that connects to a chamber 105 that extends throughout the shaft 104 of the extension bar 101 through to the first end 102 of the extension bar 101, as can be seen in FIG. 15. The second end 32 of the housing 30 sits flush against the enlarged head 116 of the second end 102. The enlarged head 116 serves to retain the housing 30 on the extension bar 101. The female receiving end 111 is capable of receiving a variety of additional tools or adaptors. The first end 102 of the extension bar 101 defines a square recess 103 therein for receiving a square head of a socket wrench 79 or power tool 70.

Figure 16:
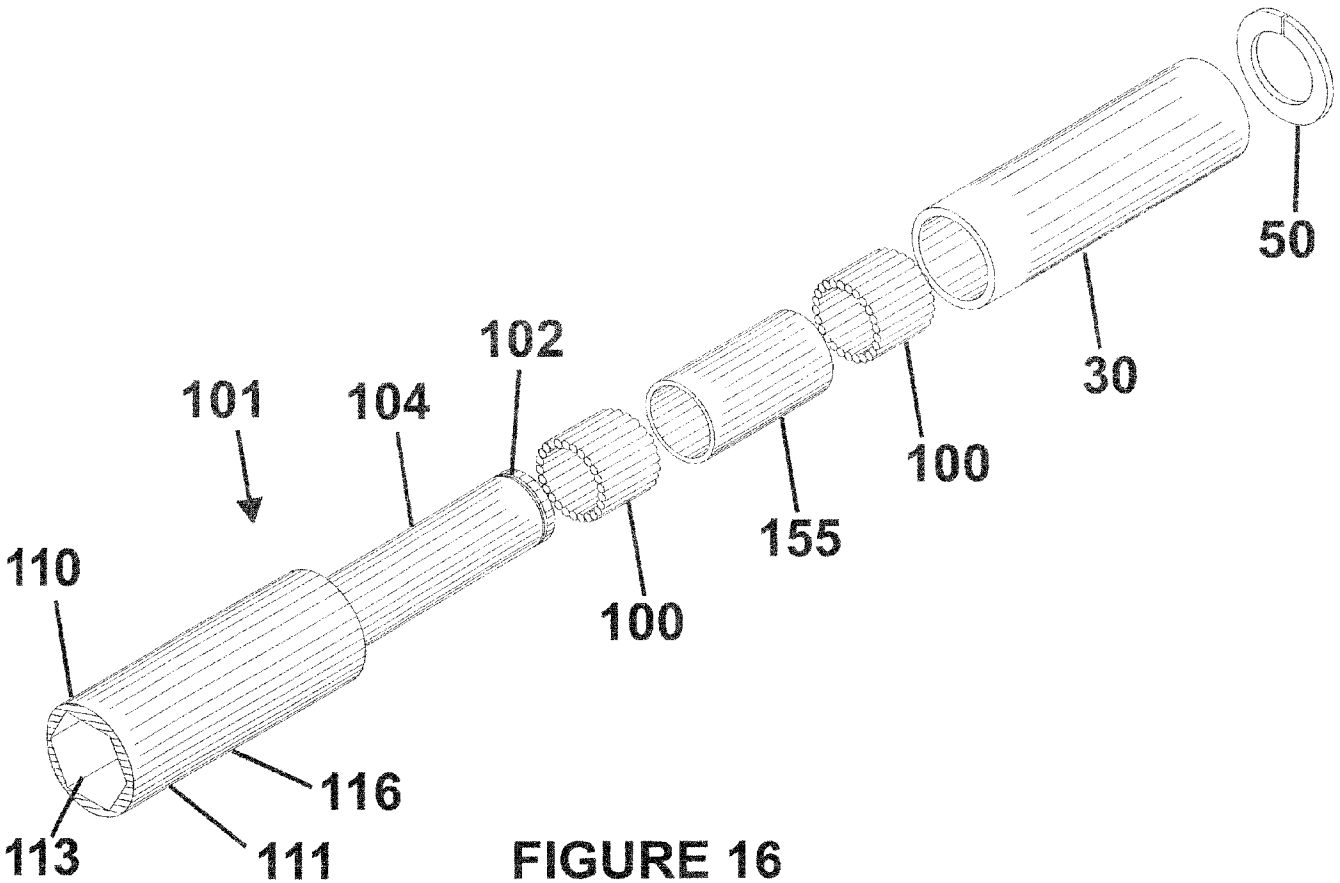
FIG. 16 shows an exploded view of an alternative embodiment of the present invention.
Figure 18B:
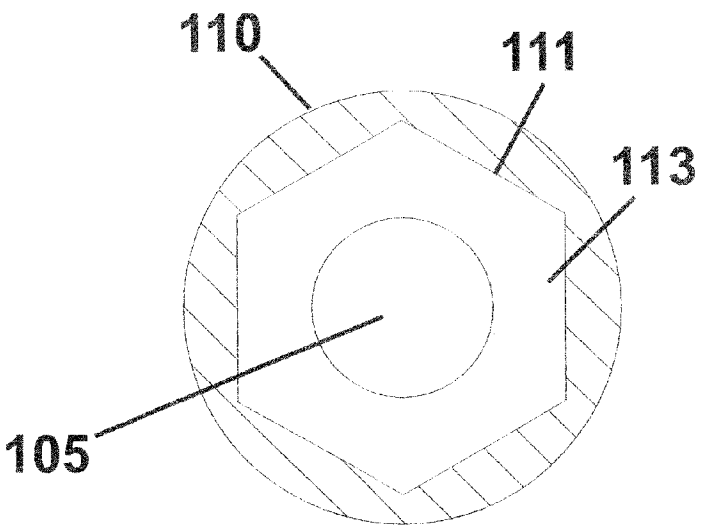
FIG. 18B shows end view of second end of the alternative embodiment of the present invention shown in FIG. 16.
Figure 18A:
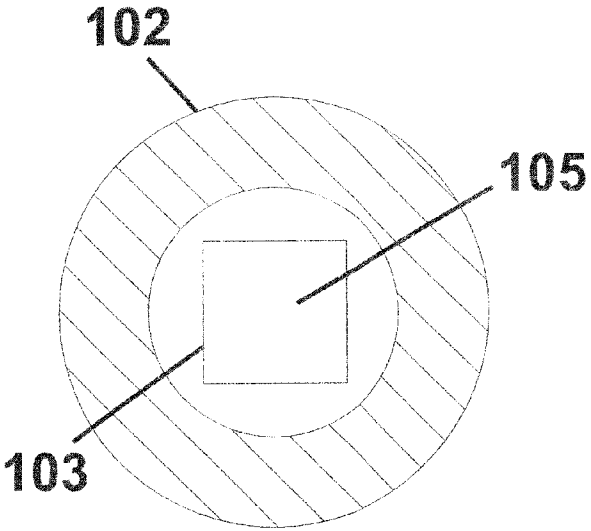
FIG. 18A shows end view of first end of the alternative embodiment of the present invention shown in FIG. 16.
Figure 19:
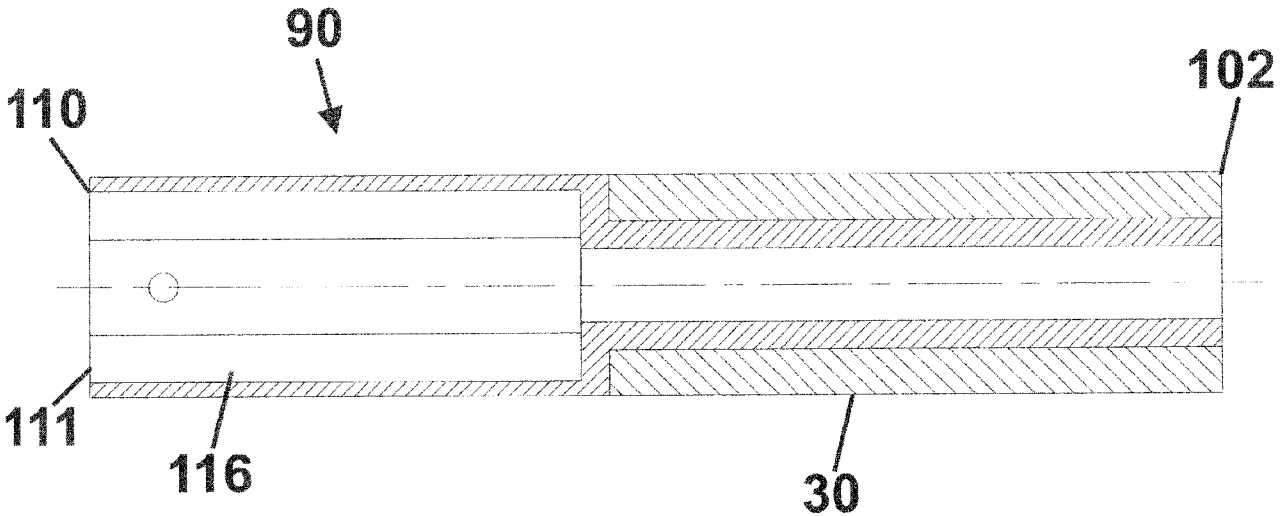
FIG. 19 shows a cut-away side view of the alternative embodiment of the present invention shown in FIG. 16.
Figure 20:
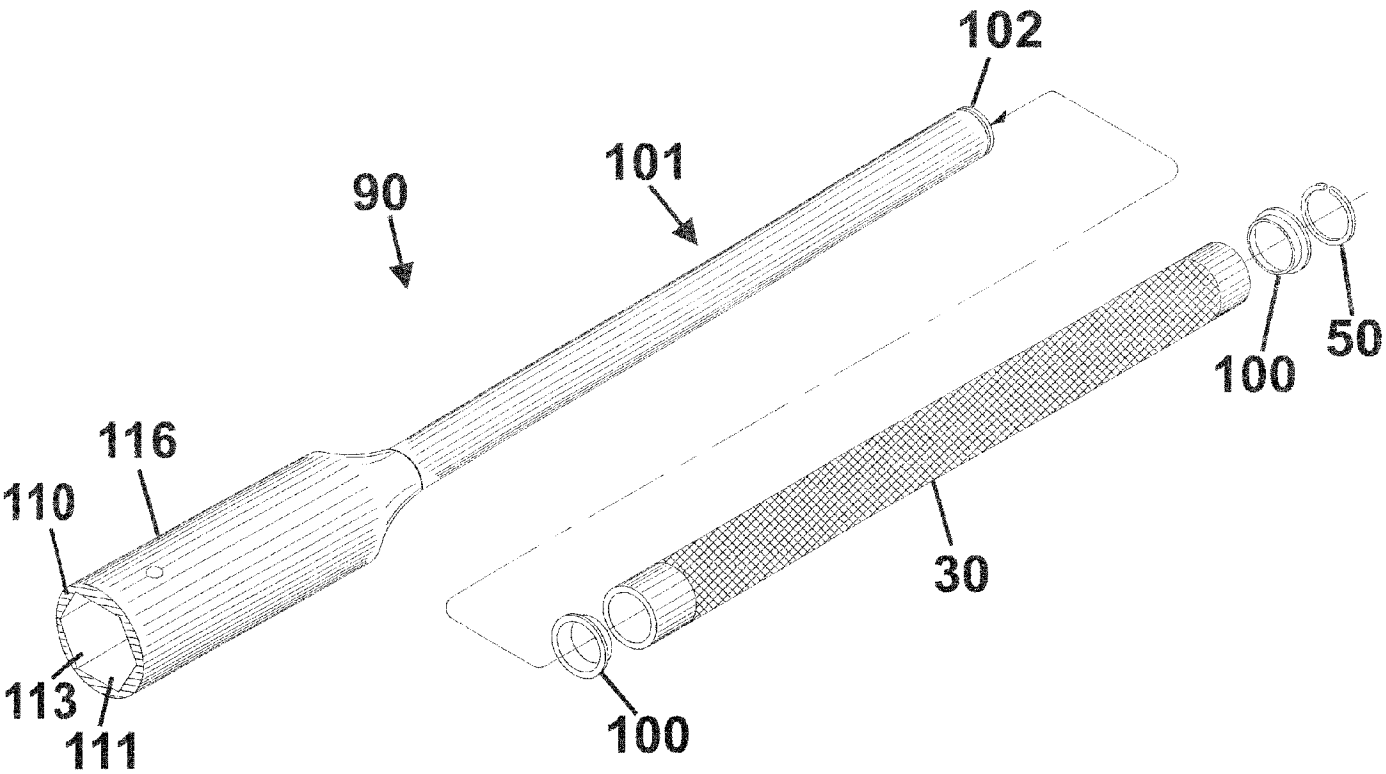
FIG. 20 shows an exploded view of an alternative embodiment of the present invention.

FIGS. 16 and 20 show alternative embodiments of the present invention. These embodiments of the present invention each have an extension bar 101 with a first and second end 102, 110 which are connected by a shaft 104. On each of the embodiments, a housing 30 is rotatably mounted onto the extension bar 101. The housing 30 may be comprised of a bushing material itself, or a friction reducing device 100 may be used to rotatably mount the housing 30 onto the shaft 104 of the extension bar 101. The extension bar 101 is capable of rotation within the housing 30. On each of the embodiments of the present invention shown in FIGS. 16 and 20, the first end 102 of the extension bar 101 defines a square recess 103 therein for receiving a square head of a socket wrench 79 or power tool 70. FIG. 17 shows the alternative embodiment shown in FIG. 17 in use in conjunction with a ratchet tool. Also shown in FIG. 17 is a magnet 115 incorporated into the wall of the enlarged head 116 of the second end 102 which is used to assist in the retaining of additional tools or adaptors designed to fit within the second end of the extension bar 101. FIGS. 18A and 18B show an end view of the first and second end 102, 110 of the alternative embodiment shown in FIG. 16, respectively. On the second end 110 of the extension bar is a female receiving unit 111 which is comprised of an enlarged head 116 with a hexagon shaped recession 113. As is shown in FIG. 19, which is a cut-away view of the alternative embodiment, the depth of the female receiving unit 111 is deeper than previously identified versions, allowing its use with tools or adaptors having a variety of functions. The depth of the enlarged head 116 and the recession 113 within the female receiving unit 111 can vary.

In FIG. 20, the extension bar 101 has a slenderized and extended shaft 104 connecting the first and second end 102, 110. The housing 30 is designed to match the slenderized and extended shaft 104 of the extension bar 101. Both of these alternative embodiments have a chamber 105 which extends from the first end 102 of the extension bar 101 though to the second end 110 of the extension bar 101, as is shown in FIG. 19. The enlarged head 116 present on the second end 110 of the alternative embodiments shown in FIGS. 16 and 22 allow the second end 110 to more readily receive various adaptors of different lengths and sizes.

Figure 21:
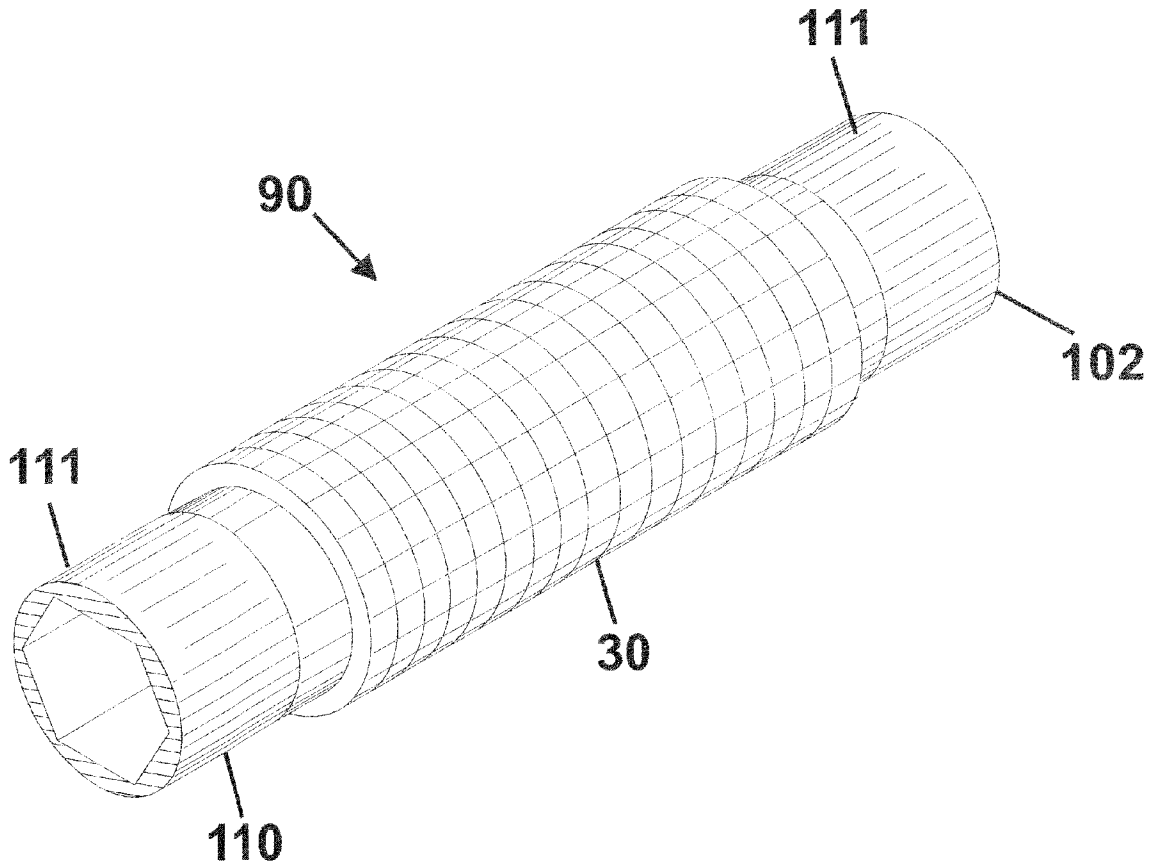
FIG. 21 shows a perspective view of an alternative embodiment of the present invention.

Another alternative embodiment of the present invention is shown in FIG. 21. In this embodiment, a tubular housing 30 surrounds the shaft 104 of the extension bar 101 and is rotatably mounted onto an extension bar 101. The extension bar 101 in this embodiment has a shaft 104 structure having a first and second end 102, 110. In this embodiment, each of the first and second ends 102, 110 of the shaft 104 structure consists of a female receiving unit 111, which are capable of receiving various adaptors which serve to enlarge the functionality of the present invention. Both of the ends 102, 110 of the extension bar 101 have enlarged heads 116 which serve to retain the housing 30 on the extension bar 101. The tubular housing 30 may be rotatably mounted onto the shaft 104 structure by any type of friction reducing device 100, such as bearings, bushings or other similar type of device. The shaft 104 structure of this embodiment may be formed by joining two or more individual shaft sections together in a variety of ways to form a complete shaft. A sampling of how the shaft structure may be comprised is discussed below in the several specific embodiments disclosed.

Figure 22:
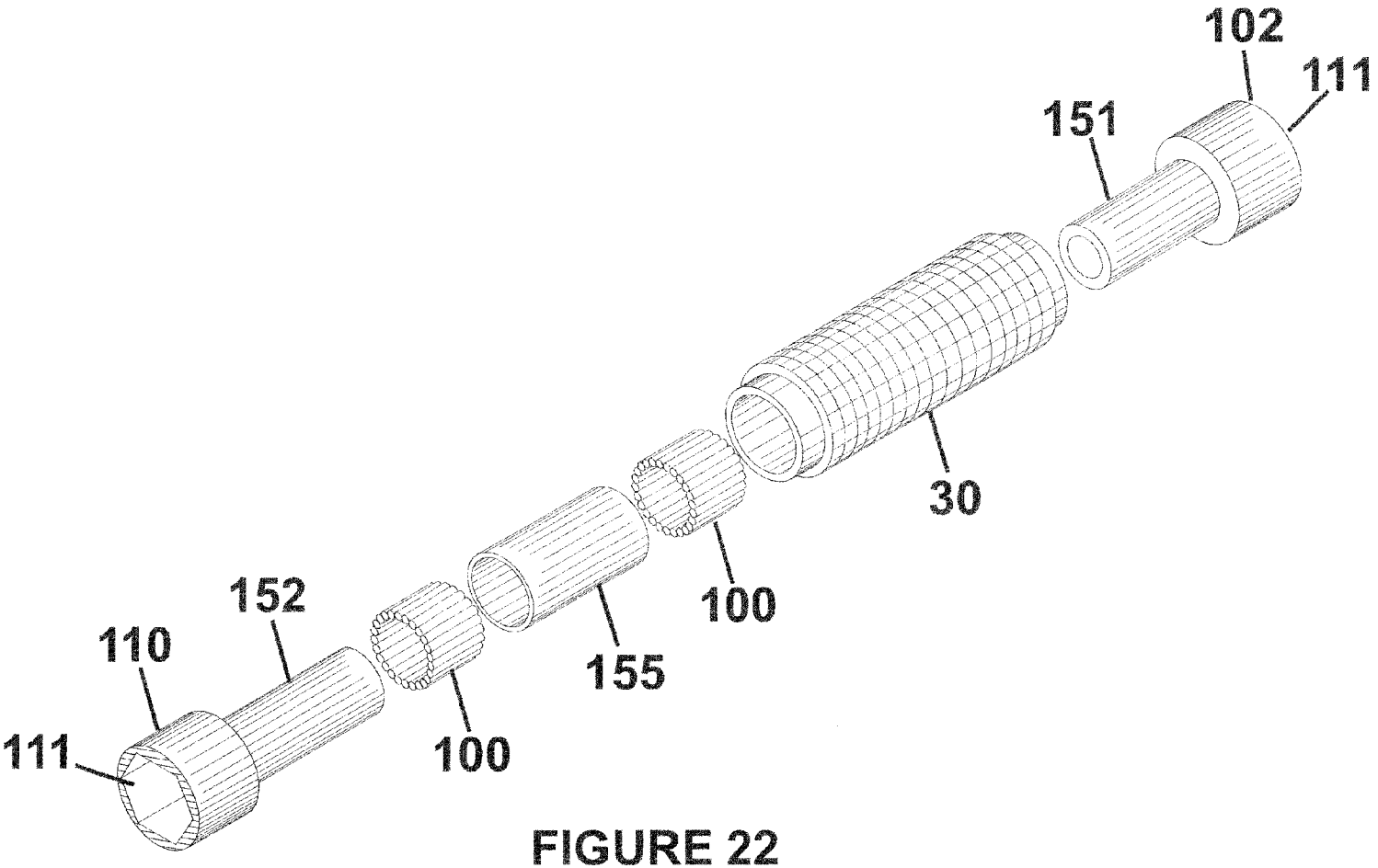
FIG. 22 shows an exploded view of an alternative embodiment of the present invention.

In one embodiment, which is shown in FIG. 22, a connector sleeve 155 is utilized to join the two individual shaft sections to form a shaft. The connector sleeve 115 is a circular and hollow unit sized to fit within the inner surface 34 of the housing 30 and used to space apart the friction reducing devices 100, which are typically placed on either end of the connector sleeve 155. In this embodiment, the shaft 104 is comprised of a first and second shaft sections 151, 152, which each extend from the first and second ends 102, 110 which are both female receiving ends 111. The diameter of the first and second shaft sections 151, 152 are sized to have a precision sliding fit through the inside round opening of the friction reducing device 100 and through one end of the connector sleeve 155. The first and second shaft sections 151, 152 are force pressed into the slightly smaller openings of the connector sleeve 155. Each of the first and second shaft sections 151, 152 are pressed approximately half way into the connector sleeve 155. The diameter of the connector sleeve 155 is designed to receive the first and second sections of the shaft 151, 152 through means of a high pressure force. When the first and second shaft sections 151, 152 are pressed into the housing 30 and into the connector sleeve 155, they form a shaft 104.

Figure 23:
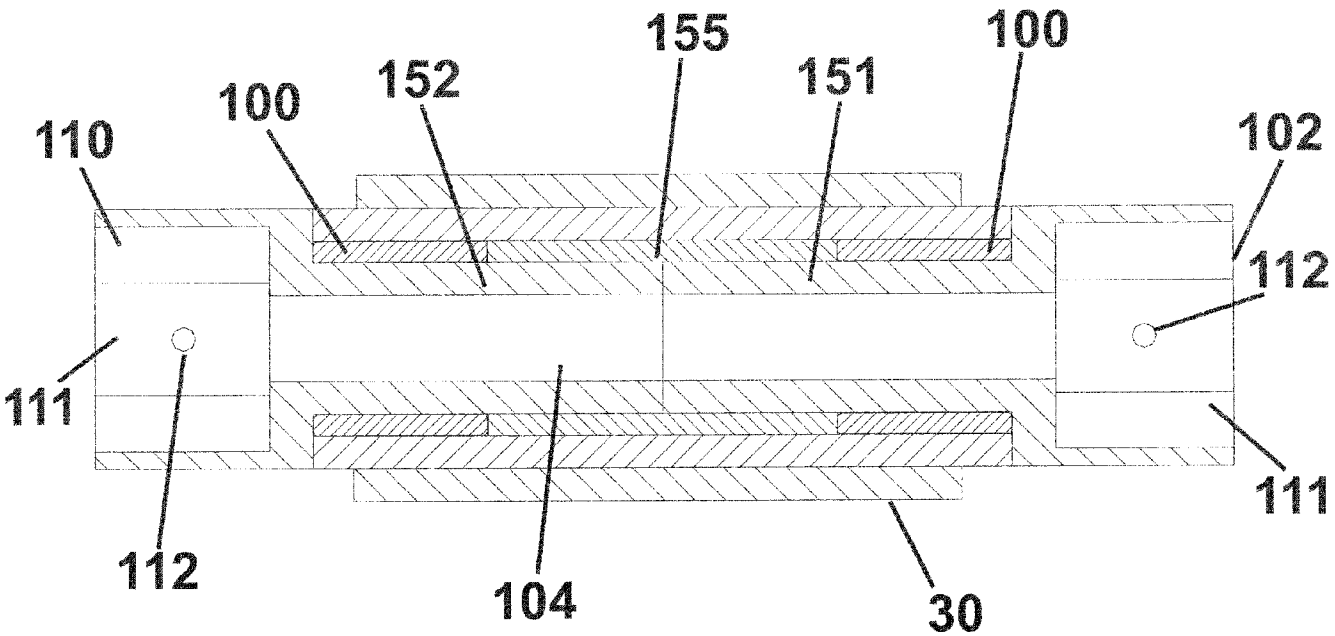
FIG. 23 shows a cut-away side view of the alternative embodiment of the present invention shown in FIG. 22.

The female receiving units 111 have a circular shaped outer periphery 112 with a hexagon shaped recession 113. Each of the recessions 113 connect with a chamber 105 that extends from the recessions 113 through the first and second shaft sections 151, 152 respectively as is shown in FIG. 23. Each of the female receiving ends 111 is capable of receiving an additional tool or an adaptor.

Figure 24:
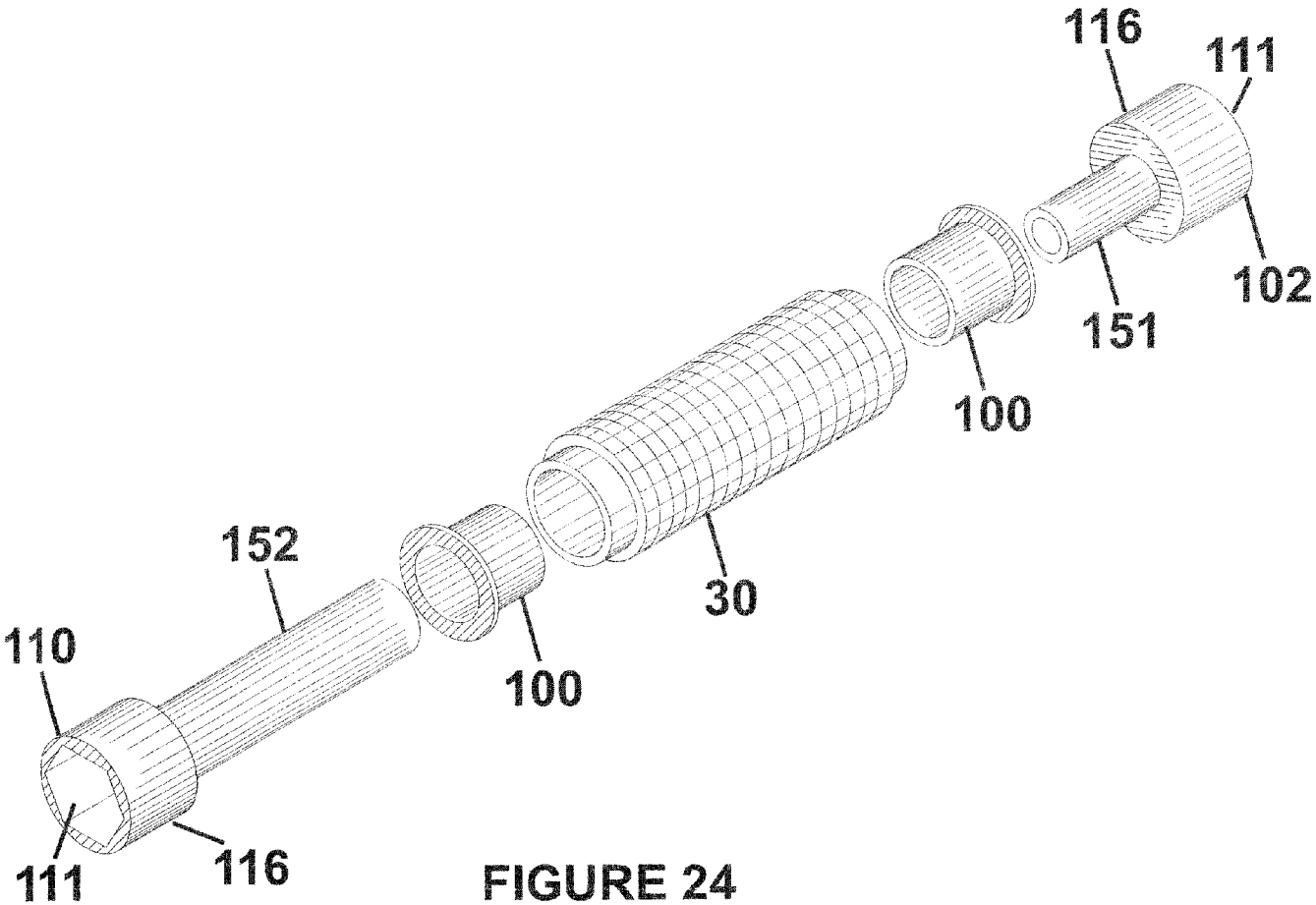
FIG. 24 shows an exploded view of an alternative embodiment of the present invention.

Another alternative embodiment of the present invention is shown in FIG. 24, which also utilizes two individual shaft sections 151, 152 to form a shaft 104 with female receiving units 111 on each end, similar to the embodiment shown in FIG. 22. In the embodiment shown in FIG. 24, a connector sleeve 155 is not utilized but rather the shaft is again comprised of a first and second shaft section 151, 152 which each extend from the first and second female receiving units 111 respectively. The first shaft section 151 is sized so that it has a smaller diameter than the second shaft section 152. The second shaft section 152 is hollow and may by longer in length than the first shaft section 151. Thus, as is shown in FIG. 24, the first shaft section 151, which is shorter in length and smaller in diameter than the second shaft section 152, will press fit into the second shaft section 152, thus fitting the shaft sections 151, 152 together to form a single shaft 104. In this embodiment, a housing is also rotatably mounted on the shaft and a variety of friction reducing devices 100 may be used to rotatably mount the housing 30. In FIG. 24, bushings are utilized.

Figure 27A:
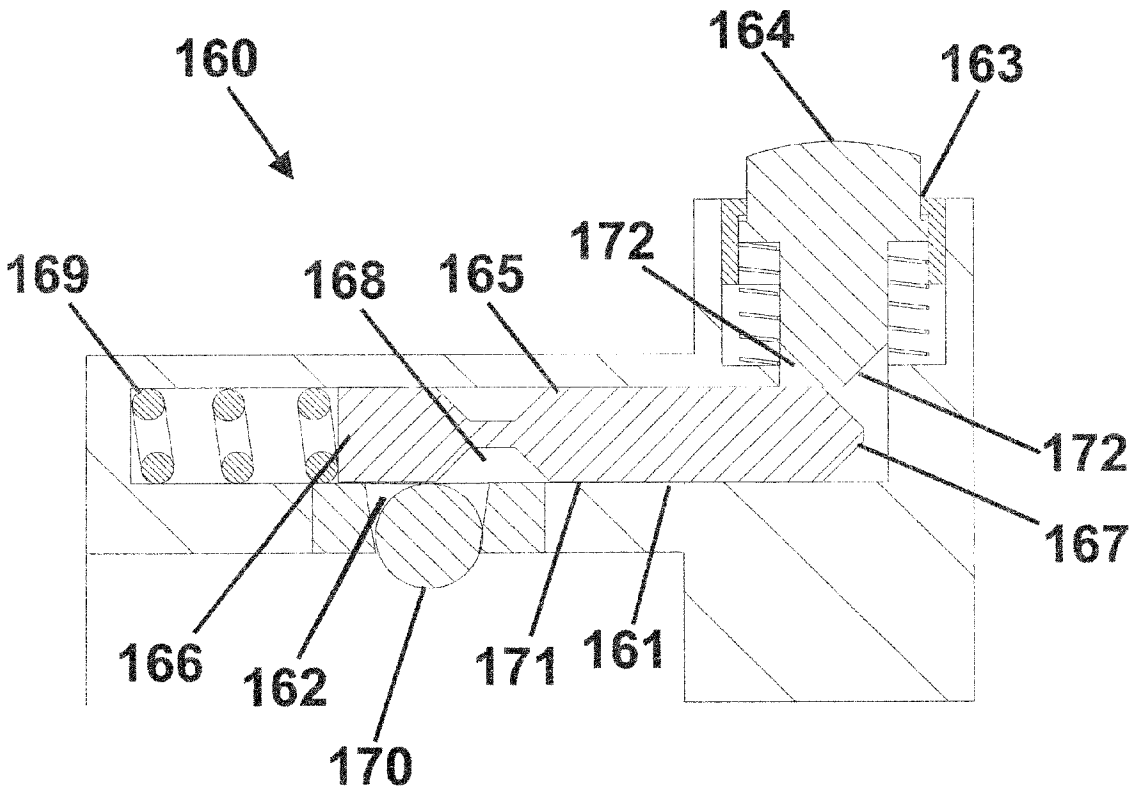
FIG. 27A shows cut-away view of the coupling mechanism present on the adaptors in relaxed position.
Figure 27B:
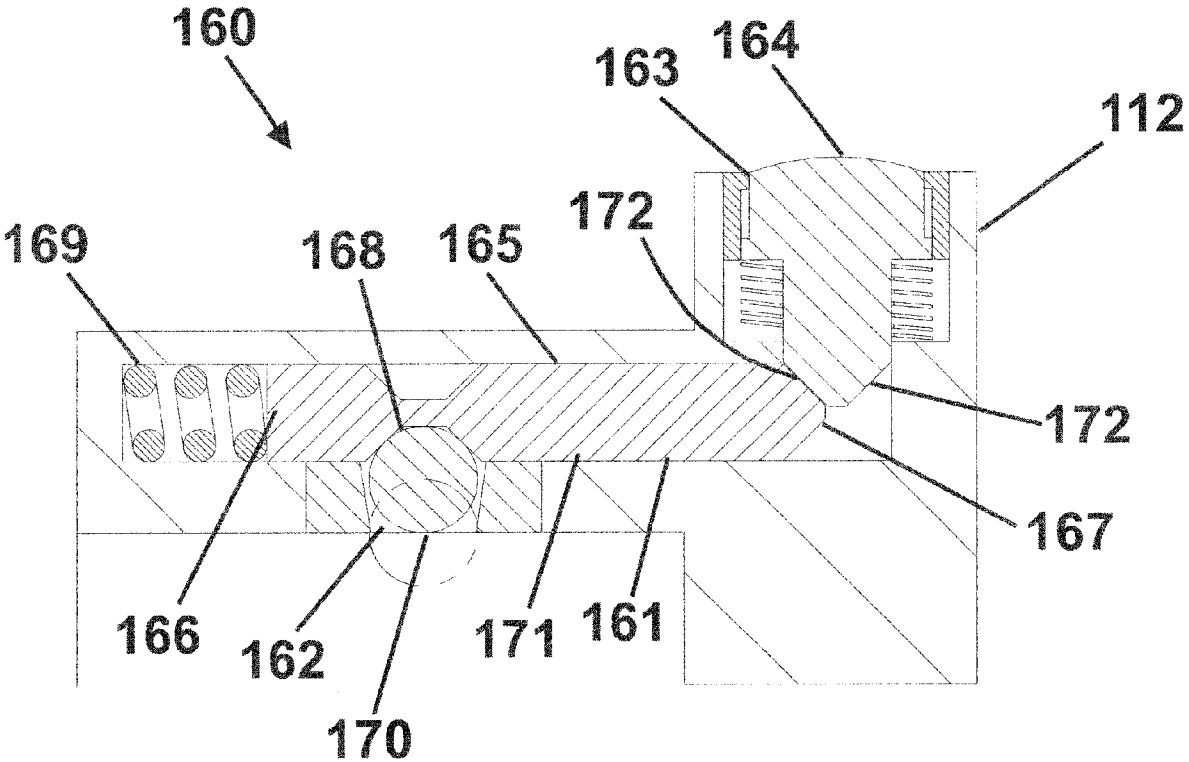
FIG. 27B shows cut-away view of the coupling mechanism present on the adaptors in depressed position.

The female receiving units 111 each have a hexagon shaped recession 113 which meets with a chamber 105 extending into the first and second shaft sections 151, 152. Each of the female receiving ends 111 is capable of receiving an additional tool or an adaptor to enlarge the functionality of the tool. Additionally, each of the female receiving units have a detent 114 to receive the ball 140 of a coupling mechanism similar to the one shown in FIGS. 27A and 27B.

Figure 25:
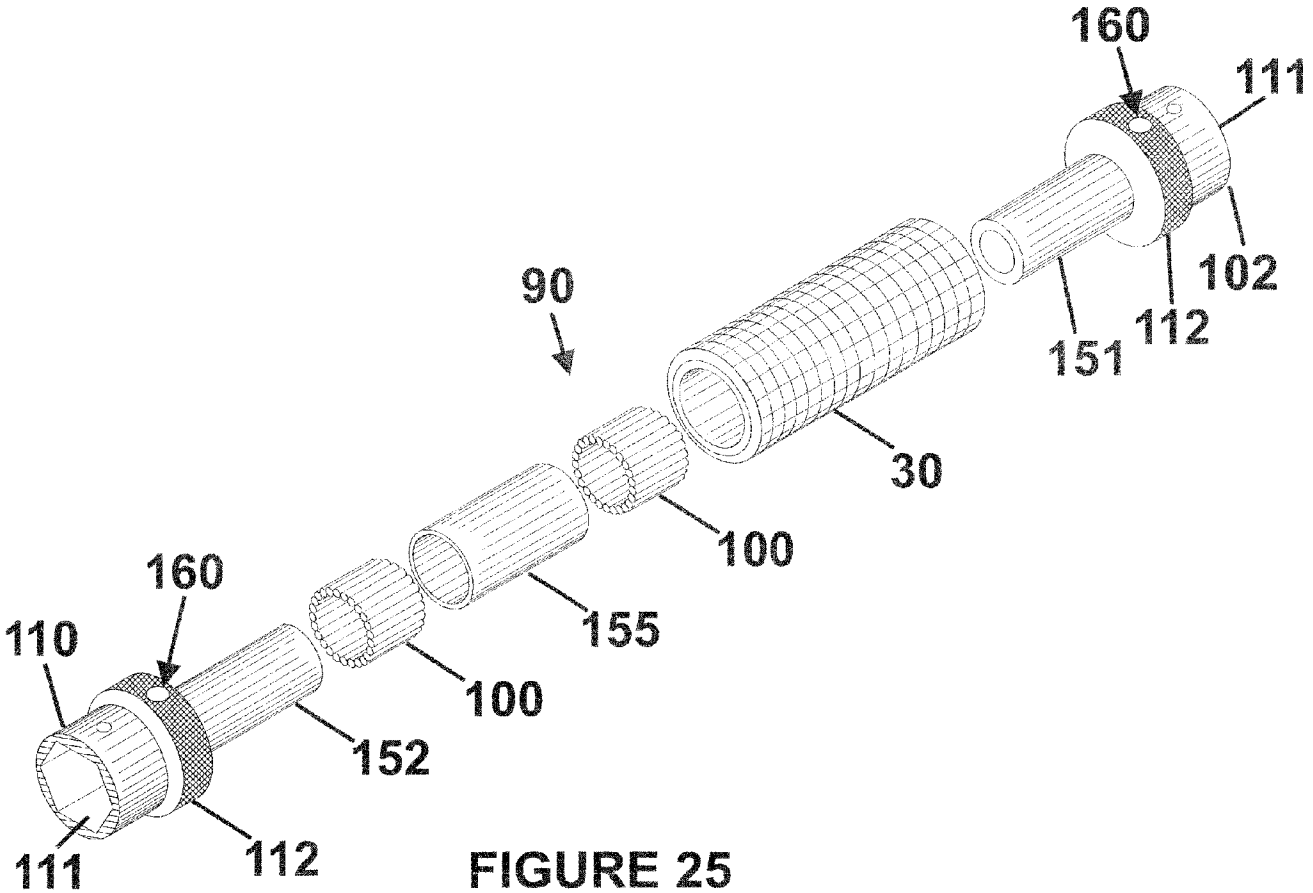
FIG. 25 shows an exploded view of an alternative embodiment of the present invention.
Figure 26:
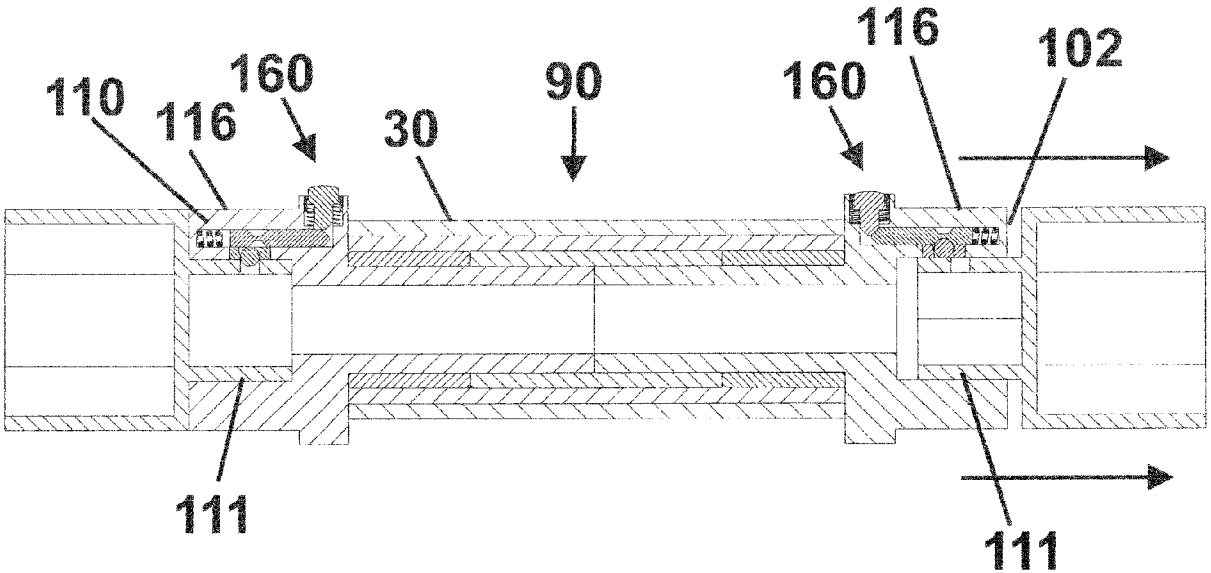
FIG. 26 shows a cut-away side view of the alternative embodiment of the present invention shown in FIG. 25.

In the embodiment shown in FIGS. 25 and 26, an alternative embodiment of the present invention is shown wherein the female receiving units 111 each have a coupling mechanism 160 incorporated into them. In this embodiment, the coupling mechanism 160 of the female receiving unit 111 mates with a detent in an adaptor or socket which is inserted into the female receiving unit 111. Each of the female receiving units 111 is composed of an enlarged head 116 and with a collar 112 which is near at least one of the first or second ends 102, 110 of the extension bar 101. A coupling mechanism 160, such as the one shown in FIGS. 27A and 27B, can be used on the female receiving unit 111. The coupling mechanism 160 includes a longitudinal chamber 161 extending from the female receiving unit 111 through the collar 112 located at the end of the enlarged head 116 of the female receiving unit 111. A ball receiving opening 162 is present on the outer periphery 112 of the female receiving unit 111. The ball receiving opening 162 connects to the chamber 161. A press button receiving opening 163 is present on the outer periphery of the collar 112 and the opening 163 connects to the chamber 161. A press button 164 is movably mounted in the press button receiving opening 162. A drive rod 165 is slidably mounted in the chamber 161 having a first end 166 in communication with a biasing member 169 mounted in the chamber 161 between the first end 166 of the drive rod 165 and the wall 171 of the chamber 161. Near the first end 166 of the drive rod 165 is a ball receiving recess 168 aligning with the ball receiving opening 162. The second end 167 of the drive rod 165 defines a slanted surface 172 which communicates with the press button 164 and is aligned with the press button receiving opening 163. A ball 170 is movably mounted in the ball receiving opening 162 and slidably received in the ball receiving recess 168 and protruded from the ball receiving recess 168 depending upon the location of the drive rod 165 in the chamber 161. The press button 164 is slidably received by the slanted surface 172 of the second end 167 of the drive rod 165. The press button 164 is slidably extended from the press button receiving opening 163 or retreated into the press button receiving opening 163 depending upon the location of the drive rod 165 in the chamber 161. When the ball 170 is protruded, it is capable of mating with a detent in the adaptor 180 or socket and thus securing the adaptor 180 for use with the tool.

The invention claimed is:

1. A housed socket extension, comprising:

a housing with an outer surface and a first and second end with an opening extending from said first end to said second end;

a socket extension apparatus with a shaft connecting a first and second end, and said socket extension apparatus extending through said opening of said housing, said first and second ends extending from said ends of said housing;

and said housing rotating relative to said socket extension;

said first end of said socket extension apparatus having a female receiving end and a taper which extends towards said shaft;

said taper section diminishing in diameter as it extends toward said shaft and ending at a step structure providing a rim around the end of said taper section;

said first end of said housing aligning flush with said rim of said taper section providing a continuous surface between said taper section and said housing;

at least one bearing residing within the opening of said housing and held in place by a bearing retaining device.

* * * * *